US010561922B2

(12) United States Patent
Sanchez et al.

(10) Patent No.: US 10,561,922 B2
(45) Date of Patent: Feb. 18, 2020

(54) IMPACT INDICATION AND DATA TRACKING DEVICES, SYSTEMS, AND METHODS

(71) Applicant: ArthroKinetic Institute, LLC, Santa Barbara, CA (US)

(72) Inventors: Eric Sanchez, Santa Barbara, CA (US); Robert Woods, Henderson, NV (US); Gavin Braithwaite, Boston, MA (US); Stephen Spiegelberg, Boston, MA (US)

(73) Assignee: ArthroKinetic Institute, LLC, Montecito, CA (US)

( * ) Notice: Subject to any disclaimer, the term of this patent is extended or adjusted under 35 U.S.C. 154(b) by 356 days.

(21) Appl. No.: 15/368,129

(22) Filed: Dec. 2, 2016

(65) Prior Publication Data

US 2017/0274262 A1 Sep. 28, 2017

Related U.S. Application Data

(62) Division of application No. 14/206,866, filed on Mar. 12, 2014, now abandoned.

(Continued)

(51) Int. Cl.

| | |
|---|---|
| ***A63B 69/36*** | (2006.01) |
| *A63B 71/14* | (2006.01) |
| *A63B 71/06* | (2006.01) |

(52) U.S. Cl.

CPC ..... *A63B 69/3617* (2013.01); *A63B 71/146* (2013.01); *A63B 2069/362* (2013.01);

(Continued)

(58) Field of Classification Search

CPC ..... A63B 2220/40; A63B 2225/50; A63B 2071/0694; A63B 2209/14;

(Continued)

(56) References Cited

U.S. PATENT DOCUMENTS 2,660,436 A 11/1953 Grossman
3,730,529 A * 5/1973 Donofrio ..... A63B 69/3617 473/236

(Continued)

OTHER PUBLICATIONS

[No Author Listed] 3BaysGSA. Perception Digital, Ltd. Product information. Retrieved on Oct. 29, 2014 from <http://www.3bayslife.com/gsa/home.php>. 23 pages, 2012.

(Continued)

*Primary Examiner* — Justin L Myhr

(74) *Attorney, Agent, or Firm* — Lee Sullivan Shea & Smith LLP

(57) ABSTRACT

Devices and methods are generally provided for indicating the location of a most recent strike on a face of a golf club. One exemplary embodiment of an impact indication device can include a patch that can be attached to the face of a golf club and can display the impact location of a most recent strike without displaying impact locations of previous strikes. The impact locations of previous strikes can be removed from the patch without the user having to do anything more than take another swing. In some embodiments, the device includes a yield-stress material that assist in displaying impact a most recent impact location without displaying previous impact locations. Other features that can allow patches to work in this fashion, as well as methods related to the same, are also provided. Further, disclosures pertaining to a mobile impact recorder are also provided.

15 Claims, 11 Drawing Sheets

Related U.S. Application Data

(60) Provisional application No. 61/798,144, filed on Mar. 15, 2013, provisional application No. 61/798,320, filed on Mar. 15, 2013.

(52) U.S. Cl.
CPC ... *A63B 2071/0694* (2013.01); *A63B 2209/00* (2013.01); *A63B 2209/10* (2013.01); *A63B 2209/14* (2013.01); *A63B 2210/50* (2013.01); *A63B 2220/13* (2013.01); *A63B 2220/40* (2013.01); *A63B 2220/801* (2013.01); *A63B 2225/50* (2013.01)

(58) Field of Classification Search
CPC ..... A63B 69/3617; A63B 71/146; A63B 2220/62; A63B 24/0003
See application file for complete search history.

(56) References Cited

U.S. PATENT DOCUMENTS 4,834,500 A 5/1989 Hilsum et al.
4,991,850 A * 2/1991 Wilhlem ..... A63B 69/3632 473/233
5,033,746 A 7/1991 Jones
5,142,309 A 8/1992 Lee
5,223,958 A 6/1993 Berry
5,597,361 A 1/1997 Hope
5,709,610 A * 1/1998 Ognjanovic ..... A63B 69/3617 473/220
5,779,556 A 7/1998 Cervantes et al.
5,805,245 A 9/1998 Davis
6,299,553 B1 10/2001 Petuchowski et al.
6,312,344 B1 11/2001 Smith
6,941,818 B2 9/2005 Rakowski
7,134,967 B2 * 11/2006 Lester ..... A63B 69/3617 473/237
7,219,033 B2 5/2007 Kolen
7,494,430 B2 2/2009 Choi
7,736,242 B2 6/2010 Stites et al.
7,821,407 B2 10/2010 Shears et al.
8,052,539 B2 11/2011 Kimber
8,092,315 B2 1/2012 Swartz et al.
8,109,816 B1 2/2012 Grober
8,118,687 B1 2/2012 Galloway
8,257,189 B2 9/2012 Koudele et al.
8,425,292 B2 4/2013 Lui et al.
8,430,770 B2 4/2013 Dugan
8,449,402 B2 5/2013 Jaekel et al.
8,465,376 B2 6/2013 Bentley
2005/0054457 A1 3/2005 Eyestone et al.
2005/0288119 A1 12/2005 Wang et al.
2006/0025229 A1 * 2/2006 Mahajan ..... A63B 24/0003 473/131
2006/0052173 A1 3/2006 Telford
2007/0270214 A1 11/2007 Bentley
2008/0015050 A1 * 1/2008 Tavares ..... A63B 53/0475 473/346
2008/0287205 A1 11/2008 Katayama
2009/0247312 A1 10/2009 Sato et al.
2010/0093458 A1 * 4/2010 Davenport ..... A63B 53/0466 473/223
2010/0144456 A1 6/2010 Ahem
2010/0204616 A1 8/2010 Shears et al.
2010/0222152 A1 * 9/2010 Jaekel ..... A63B 69/3617 473/223
2011/0124440 A1 5/2011 Ueda et al.
2011/0183780 A1 7/2011 Leech et al.
2011/0184538 A1 7/2011 Baker et al.
2011/0224012 A1 9/2011 Hashimoto et al.
2011/0230273 A1 * 9/2011 Niegowski ..... A43B 3/0005 473/199
2011/0250939 A1 10/2011 Hobler
2012/0035003 A1 2/2012 Moran et al.
2012/0052972 A1 3/2012 Bentley
2012/0143093 A1 6/2012 Stirling et al.
2012/0157241 A1 6/2012 Nomura et al.
2012/0277018 A1 * 11/2012 Boyd ..... A63B 24/0003 473/224
2012/0296454 A1 11/2012 Lui et al.
2012/0316004 A1 12/2012 Shibuya
2012/0322569 A1 * 12/2012 Cottam ..... A63B 69/3617 473/223
2013/0059672 A1 3/2013 Davenport
2013/0090179 A1 4/2013 Davenport
2013/0095940 A1 4/2013 Dugan
2013/0095941 A1 4/2013 Bentley et al.
2013/0102419 A1 4/2013 Jeffery et al.
2013/0165246 A1 6/2013 Jeffery et al.
2013/0203518 A1 8/2013 Hatton et al.
2013/0225335 A1 8/2013 Dugan
2013/0267339 A1 10/2013 Boyd et al.
2013/0329149 A1 12/2013 Jang et al.
2014/0274438 A1 9/2014 Molinari
2014/0274439 A1 9/2014 Sanchez et al.

OTHER PUBLICATIONS

[No Author Listed] 5 Pack Strike N Swipe Reusable Face Tape. InnovaGolf.com. Product description. Retrieved on Sep. 16, 2014 from <www.innovagolf.com/strikenswipe.html>. 2 pages. Publication date is unknown.
[No Author Listed] Advantage Longshot. Why No Other Impact Recording System Even Comes Close. LongShotGolf.com. Product Description. Retrieved on Sep. 16, 2014 from <https://www.longshotgolf.com/pdf%20pages/AdvantageLongShot.pdf>. 1 page. Publication date is unknown.
[No Author Listed] Artengo Personal Coach. Artengo, Decathlon SA. Product information. Retrieved on Nov. 5, 2014 from <http://en.artengo.com/>. 51 pages. Publication date is unknown.
[No Author Listed] Babolat Play. Babolat VS. Product information. Retrieved on Nov. 5, 2014 from <http://en.babolatplay.com>. 17 pages. Publication date is unknown.
[No Author Listed] Blast Motion. Product information. Retrieved on Feb. 17, 2015 from <www.blastmotion.com> 33 pages. Publication date is unknown.
[No Author Listed] Flightscope. Company overview. Retrieved on Oct. 29, 2014 from <http://flightscope.com/company>. 24 pages. Publication date is unknown.
[No Author Listed] Golf. Wikipedia. Jun. 12, 2012, 18 pages. Retrieved on Nov. 5, 2014 from <http://en.wikipedia.org/w/index.php?title=Golf&oldid=497011080>. Archived version of the page as last edited Jun. 11, 2012.
[No Author Listed] Handbook of Thermochromic Liquid Crystal Technology. Hallcrest, Glenview, IL, 1991, 36 pages.
[No Author Listed] Introducing Game Golf: The World's first automatic shot tracking system for today's golfer. Game Golf. Active Mind Technology, Inc. 2014, 5 pages. Retrieved on Sep. 16, 2014 from <http://www.gamegolf.com/products/en-us/gamegolf>.
[No Author Listed] Lot of 3 Dead on Impact Indicator Marker. DeadOn: Impact Indicator. Retrieved on Oct. 29, 2014 from <http://www.emtcompany.com/misc/lot-of-3-dead-on-impact-indicator-marker.html>. 3 pages. Publication dated is unknown.
[No Author Listed] Nike+ FuelBand: First Generation. Nike, Inc. Product information. Retrieved on Oct. 29, 2014 from <http://www.amazon.com/Nike-WM0105-001-FuelBand-Black-Small/dp/B008RRLJUI>. 6 pages, 2012.
[No Author Listed] Nike+ iPod. Nike, Inc., and Apple, Inc. Product information. Retrieved on Oct. 29, 2014 from (http://www.apple.com/ipod/nike/run.html>. 3 pages. Publication date is unknown.
[No Author Listed] Nike+ Livestrong SportBand. Nike, Inc. Product information. Retrieved on Oct. 29, 2014 from <http://www.sports-accessory.com/2011/1108/nike-livestrong-sportband/>. 7 pages, 2011.
[No Author Listed] Nike+ Sensor. Nike, Inc., and Apple, Inc. Product information. Retrieved on Oct. 29, 2014 from <http://store.nike.com/us/en_us/pd/sensor/pid-162953/pgid-781981>. 5 pages. Publication date is unknown.

(56) References Cited

OTHER PUBLICATIONS

[No Author Listed] Nike+ Sportband. Nike, Inc. Product information. Retrieved on Oct. 29, 2014 from <https://secure-nikeplus.nike.com/plus/products/sport_band>. 5 pages. Publication date is unknown.
[No Author Listed] Nike+ Sportwatch GPS. Nike, Inc. Product information. Retrieved on Oct. 29, 2014 from <https://secure-nikeplus.nike.com/plus/products/sport_watch>. 3 pages. Publication date is unknown.
[No Author Listed] Sensor Products Inc: Tactile Pressure Experts. Sensor Products Inc. Company overview. Retrieved Oct. 29, 2014 from <http://www.sensorprod.com/index.php>, 4 pages. Publication date is unknown.
[No Author Listed] Sony Smart Tennis Sensor. Sony Corporation. Product information. Retrieved on Nov. 5, 2014 from <http://smarttennissensorsony.net/NA/>. 10 pgs. Publication date is unknown.
[No Author Listed] Swingbyte 2. Swingbyte. Product information. Retrieved on Oct. 29, 2014 from <https://www.swingbyte.com/store>. 1 page. Publication date is unknown.
[No Author Listed] SwingTIP—Golf Swing Analyzer Sensor and App. Mobiplex, Inc. Product information. Retrieved on Oct. 29, 2014 from <http://mobicoach.com/product/swingtip-golf-swing-analyzer/>. 6 pages. Publication date is unknown.
[No Author Listed] Tekscan. Company overview. Retrieved on Oct. 29, 2014 from <http://www.tekscan.com>, 11 pages. Publication date is unknown.
[No Author Listed] Zepp. Zepp US Inc. Product information. Retrieved on Oct. 29, 2014 from <https://www.zepp.com/store>. 11 pages. Publication date is unknown.
Aeschliman et al., Use of shear-stress-sensitive, temperature-insensitive liquid crystals for hypersonic boundary-layer transition detection. Sandia National Labs, Apr. 1, 1997, 30 pages.
Cheetham et al., Comparison of kinematic sequence parameters between amateur and professional golfers. Science and Golf V Proceedings of the World Scientific Congress of Golf, pp. 30-36, 2008.
Cheetham, P.J., Analyzing the Golf Swing in 6 Degrees of Freedom with AMM 6DOF Systems. Published Jun. 6, 2012, 11pgs. Retrieved on Nov. 5, 2014 from <http://philcheetham.com/analyzing-the-golf-swing-in-6-degrees-of-freedom-with-amm-6dof-systems/>.
Normani, Franco, The physics of a golf swing. Real World Physics Problems. Jun. 13, 2012, 12 pages. Retrieved on Nov. 5, 2014 from <http://www.real-world-physics-problems.com/physics-of-a-golf-swing.html>.
Ogawa et al., Visualization of impact force using pressure sensitive paper. Journal de Physique IV France, vol. 10, issue PR9, pp. 185-190, 2000.
Penner, A.R., The physics of golf. Reports on Progress in Physics, vol. 66, pp. 131-171, 2003.

* cited by examiner

IMPACT INDICATION AND DATA TRACKING DEVICES, SYSTEMS, AND METHODS

CROSS REFERENCE TO RELATED APPLICATIONS

The present disclosure claims priority to and is a divisional application of U.S. patent application Ser. No. 14/206,866, filed Mar. 12, 2014, and entitled "Impact Indication and Data Tracking Devices and Methods," which claims priority to both U.S. Provisional Application No. 61/798,144, filed on Mar. 15, 2013, and entitled "Impact Indication Devices and Methods" and U.S. Provisional Application No. 61/798,320, filed on Mar. 15, 2013, and entitled "Mobile Tracking Devices and Methods," each of which is incorporated by reference herein in its entirety.

FIELD

The present disclosure generally relates to devices and methods for indicating the location of a golf ball strike on a face of a golf club head.

BACKGROUND

The game of golf is played by over 26 million people in the United States, and is expected to continue to grow in popularity through at least 2020. Internationally, the popularity of golf is even more rapidly on the rise, including in Europe (e.g., France, Germany, and Russia), Japan, China, Korea, Vietnam, Mexico, and in many South American countries. In fact, in 2016, golf will be part of the Olympics for only the third time in the Games' history, and the first time since 1904.

Anybody who has ever played golf or seen golf being played understands its very challenging nature. Duffers, amateurs, and professionals alike are all typically interested in finding ways to improve at the game, for instance by maximizing distance while maintaining accuracy. Golfers of all ability levels invest hundreds-of-thousands of dollars a year practicing and playing the game in an effort to improve. Likewise, golfers of all ability levels invest hundreds-of-thousands of dollars on lessons and various tools to help improve their games, including impact tape, club weights, hitting mats, hitting cages, swing speed radar devices, swing plane trainers, wrist braces, arm braces, stance correctors, folding clubs, buckets of balls at the driving range, and lessons from golf professionals.

One sure-fire way to be a better golfer is to hit the ball with the correct portion of the golf club head more consistently. Most golf club heads are designed such that balls struck by a certain portion of the head—typically near a center on a face of the head—will travel farther and straighter than balls struck by other portions of the head. This certain portion of the head is sometimes referred to as a club head's "sweet spot." However, during the course of a swing, and directly thereafter, it is difficult for a golfer to know exactly which part of the face made contact with the ball, and thus whether the golfer hit any part of the sweet spot.

Although both sophisticated and simplistic tools exist for informing a golfer as to the portion of the club face on which the ball hit, they are deficient for a variety of reasons. Stage simulators represent one example of a sophisticated tool that allows a golfer to know the location of a ball strike. They require scheduled time, however, can be costly, and may require more than one visit. Additionally, depending on the technology, simulators may require wiring an individual or the use of videos and sensors surrounding the player to record the desired data parameters—variables that may be intimidating, detrimental, and/or cost prohibitive for many golfers of many skill levels.

More simplistic tools also suffer from a variety of deficiencies. For example, some devices mark each ball strike on the device, and thus as the number of strikes increase, it can be difficult to tell which strike was the most recent. Such devices have a very limited number of uses. While some devices exist that allow a location of a ball strike to be removed from the device prior to performing another ball strike, such devices typically require the user to manually "reset" or clear the device of the previous ball strike, for instance by wiping it off with his or her finger before performing another ball strike. In still other embodiments, the devices can require a user to mark a location of the ball strike with a writing utensil, such as a pen, after each swing. Still further, existing technologies designed to properly measure a golfer's swing are limited to obtrusive simulators, time consuming lessons, or expensive hardware with complicated software.

Accordingly, it is desirable to provide devices and methods that allow a golfer to know a location of a ball strike after each swing, and which can record more ball strikes using a single device than existing devices. It is also desirable to provide devices and methods that allow a user to perform multiple strikes in a row and see the ball strikes for each swing without having that view impeded by previous ball strikes or having to perform extra steps such as wiping or marking the club face manually before performing the next ball strike. Still further, it is desirable to provide devices and methods that provide convenient, real-time feedback to the golfer so that the golfer can make adjustments to his or her swing in real-time.

SUMMARY

Devices and methods are generally provided for indicating the location of a most recent strike on a face of a golf club, or more particularly a patch attached thereto. In one exemplary embodiment of an impact indication device, the device can include a patch having a back surface that is removably and replaceably attachable to a face of a golf club and a ball-striking surface configured to visually display an impact location where the patch most recently struck a golf ball. The patch can display the impact location of a most recent strike without displaying impact locations of previous strikes. Further, the patch can be configured to reset itself to no longer display the impact locations of previous strikes after the most recent strike occurs such that no action beyond swinging the golf club again is required by a user between strikes. In some embodiments, the next golf swing that makes contact with a ball can reset the device so that the previous ball strike is no longer visible. Further, in some embodiments, the patch can include a sensor disposed therein, which can be configured to measure data related to golf ball strikes made by the patch.

A variety of mechanism can be relied upon to display the impact location and remove old impact locations. In some embodiments the patch can include a yield-stress material disposed therein between ball-striking and back surfaces. The yield-stress material can be configured to be displaced in response to the most recent strike, and in turn can allow the impact location of the most recent strike to be known based on the location from which the material was displaced.

Further, the displacement of the yield-stress material following a strike can display one or more indicia located on a top face of the back surface, which can provide feedback regarding the impact location from the most recent strike. In some embodiments the patch can be configured to reset itself by striking a golf ball. A reset patch is one in which old ball strikes are no longer visible on a face of the patch, or if they are visible, their presence is negligible with respect to the rest of the patch and a most recent ball strike if it exists.

Another example of mechanisms that can be relied upon to display the impact location and remove old impact locations are liquid crystal films. Liquid crystal films can be disposed between the ball-striking and back surfaces of the patch, and can be configured to change colors in response to the most recent strike to display the impact location of the most recent strike while no longer displaying the impact locations of the previous strikes.

In another exemplary embodiment of an impact indication device, the device includes a base layer and an exposure layer. The base layer can have one or more information-providing indicia on a display surface of the base layer. The exposure layer can be disposed over the display surface of the base layer. Further, the exposure layer can include a sealed chamber with a yield-stress material disposed therein. The exposure layer can be configured such that impact from an outside force at an impact location can displace the yield-stress material at the impact location to reveal the base layer. In some embodiments, a second impact from an outside force at a second impact location can again displace the yield-stress material, this time at the second impact location, to reveal the base layer. To the extent that the second impact location does not overlap with the first impact location, the yield-stress material can flow back to non-overlapping portions of the first impact location in the exposure layer.

Optionally, a cover layer can be disposed over the exposure layer, and can be substantially inelastic. Alternatively, the cover layer can have elastic properties allowing it to receive portions of yield-stress material displaced by an impact. Similar to the elastic reservoir, the elasticity of the cover layer in such embodiments can be configured such that the cover layer's elasticity can push the yield-stress material back into the exposure layer at a time after the impact occurs.

The yield-stress material can include a hydrogel. Further, a back surface of the base layer can comprise an adhesive, for instance to assist in attaching the device to a surface, such as a face of a golf club. The adhesive can be reusable such that the base layer can be adhered to and removed from a first surface and subsequently adhered to a second surface. In some embodiments, a sensor can be attached to either the base layer or the exposure layer, and can be configured to measure data related to impacts received by the device.

A volume of the yield-stress material disposed in the chamber of the exposure layer can be less than an approximate volume of the chamber. In such instances, the chamber can be vacuum-sealed. In some embodiments safety measures can be included to reduce the risk of damage resulting from failure of the device. One such example can include an inner membrane disposed in either the base layer or the exposure layer. The inner membrane can have a fluid disposed therein and can be configured to release the fluid into the respective base layer or exposure layer in which the inner membrane is disposed before the chamber of the exposure layer fails and releases the yield-stress material disposed in the chamber. The device, and more particularly the base layer, can be sized and attached to a face of a golf club.

In one exemplary method of tracking a location of impact on a golf club, the method can include swinging a golf club to hit golf balls twice. More particularly, the club can have a club head, and the head can include an indication tracking device attached to it. The indication tracking device can visually identify a location at which the club head strikes the golf ball during the first swing. Further, the indication tracking device can also visually identify a location at which the club head strikes the golf ball during a second swing, while also no longer visually identifying the location of the previous strike. During the course of carrying out the method, a user touches neither the club head nor the indication tracking device to reset the indication tracking device so that it visually identifies the location of a most recent strike while no longer visually identifying the location of the previous strike. In some embodiments, after the indication tracking device visually identifies a location at which the club head strikes the golf ball, it can be the step of swinging the golf club to hit a golf ball that can reset the indication tracking device so that it identifies the location of the most recent strike while no longer visually identifying the location of the previous strike.

Further, systems and methods are generally provided for recording and storing data and other information related to a golf swing. In one exemplary embodiment, a computer-implemented method for logging data related to a golf swing on a mobile device having a computer processor coupled to a receiver, a display, and memory can include receiving by the receiver one or more golf swing data parameters, storing the golf swing data in the memory, processing the one or more data parameters by the computer processor to calculate one or more displayable indications, and displaying the one or more displayable indications on the display. The one or more golf swing data parameters can be received from a sensor attached to a head of a golf club used to execute a golf swing.

In some embodiments, the one or more displayable indications can include a visual representation of the location of a ball strike on the head of the golf club. The location of the ball strike can also be visibly displayed on an impact indication device attached to the head of the golf club. The indication device can be configured to reset itself so a location of a most recent ball strike is displayed on the indication device and locations of previous ball strikes are not displayed on the indication device. For example, the indication device can include a yield-stress material configured to be displaced in response to the most recent ball strike to display the location of the ball strike and to no longer display the locations of previous ball strikes.

The one or more data parameters can include at least one of a swing plane of the golf club during the golf swing, a location of a ball strike on the head of the golf club, and a speed of the head of the golf club during the golf swing. In some embodiments, processing the one or more data parameters can include simulating a game of golf. In some other embodiments, processing the one or more data parameters can include providing instructional analysis about the golf swing. In still other embodiments, processing the one or more data parameters can include estimating a distance a golf ball would travel in response to the golf swing based on the one or more data parameters.

The method can also include wirelessly transmitting the one or more data parameters to a remote data storage location for access to the one or more data parameters by a computer. The data received by the receiver can be first transmitted to a transmitter in communication with the sensor, and the transmitter can send the one or more data parameters to the receiver. In some embodiments, the remote data storage location is a cloud-based storage system.

In some embodiments, the method can further include receiving by the receiver one or more additional data parameters, processing the one or more additional data parameters by the computer processor to calculate one or more additional displayable indications, and displaying the one or more additional displayable indications on the display. The one or more additional data parameters can be received from an accelerometer disposed on a glove being worn by a user swinging the golf club. The one or more additional displayable indications can include an amount of vibration resulting from the ball strike on the head of the golf club. The one or more additional data parameters can be wirelessly transmitted to a remote data storage location for access to the one or more additional data parameters by a computer.

One exemplary computer implemented method for logging data related to a golf swing can include recording one or more golf swing data parameters to a memory component and performing at least one of the following two numbered courses of action: (1)(a) processing the one or more data parameters; and (b) displaying information related to the one or more data parameters on a display device; and (2) transmitting the one or more data parameters to a remote data storage location for subsequent access of the one or more data parameters by a computer. The one or more golf swing data parameters can be received from a sensor attached to a head of a golf club used to execute a golf swing.

In some embodiments, the data received from the sensor can be first transmitted to a transmitter in communication with the sensor, and the transmitter can send the one or more data parameters to the memory component. The one or more golf swing data parameters can include at least one of a swing plane of the golf club during the golf swing, a location of impact on the head of the golf club by a golf ball, and speed of the club head during the golf swing. In instances in which a golf swing data parameter includes the location of impact on the head of the golf club by a golf ball, the location of the impact can be both recorded to the memory component and visibly displayed on an impact indication device attached to the head of the golf club. The impact indication device can be configured to reset itself so a location of a most recent impact is displayed on the indication device and locations of previous impacts can not be displayed on the indication device. For example, the indication device can include a yield-stress material configured to be displaced in response to the most recent image to display the location of the impact and to no longer display the locations of previous impacts.

In some embodiments, the method for logging data related to a golf swing can further include processing the one or more golf swing data parameters to simulate a golf game. In some other embodiments, processing the one or more golf swing data parameters to provide instructional analysis about the golf swing. In still other embodiments, the one or more golf swing data parameters can include estimating a distance a golf ball would travel in response to the golf swing based on the one or more data parameters.

The one or more golf swing data parameters received from the sensor can be transmitted wirelessly. Further, transmitting the one or more golf swing data parameters to a remote data storage location can include transmitting the data parameters wirelessly to a cloud-based storage system.

The computer implemented method for logging data related to a golf swing can further include recording one or more additional data parameters to a memory component and performing at least one of the following two numbered courses of action: (1)(a) processing the one or more additional data parameters; and (b) displaying information related to the one or more additional data parameters on the display device; and (2) transmitting the one or more data parameters to a remote data storage location for subsequent access of the one or more additional data parameters by a computer. The one or more additional data parameters can include an amount of vibration resulting from impact of the head of the golf club with a golf ball.

One exemplary embodiment of a system for tracking golf-related data can include an electronic sensor, a receiver, a memory component, and at least one of a processor and a transmitter. The electronic sensor can be configured to be attached to a face of a golf club. The receiver can be configured to receive data from the electronic sensor, the data being related to a golf swing. The memory component can be configured to record data received by the receiver. The processor can be for processing data and displaying information related to the data on a display device, and the transmitter can be for transmitting the data to a remote storage location for subsequent access of the data by a computer.

In some embodiments, the receiver and the memory component can be separately located, with the receiver being configured to transmit data to the memory component wirelessly. The system can also include an impact indication device configured to be attached to the face of the golf club and visually display a location of a strike of a golf ball by the face of the golf club. In some embodiments, the electronic sensor can be a component of the impact indication device. The impact indication device can be configured to reset itself so a location of a most recent strike can be displayed on the indication device and locations of previous strikes are not displayed on the indication device. For example, the indication device can include a yield-stress material configured to be displaced in response to the most recent strike to display the location of the strike and to no longer display the locations of previous strikes.

Transmitting the data to a remote storage location can include transmitting the data wirelessly to a cloud-based storage system. In some embodiments, the system can further include an accelerometer configured to be attached to a glove being worn by a user swinging the golf club, and configured to send data measured by the accelerometer to the receiver.

BRIEF DESCRIPTION OF DRAWINGS

This invention will be more fully understood from the following detailed description taken in conjunction with the accompanying drawings, in which.

DETAILED DESCRIPTION

Figure 1A:
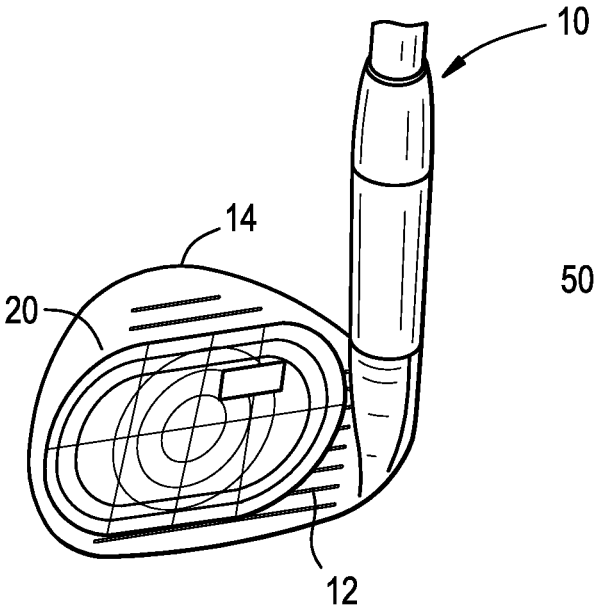
FIG. 1A is a perspective view of one exemplary embodiment of an impact indication device attached to a face of a golf club head.

Certain exemplary embodiments will now be described to provide an overall understanding of the principles of the structure, function, manufacture, and use of the devices and methods disclosed herein. One or more examples of these embodiments are illustrated in the accompanying drawings. Those skilled in the art will understand that the devices and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present invention. Further, in the present disclosure, like-numbered components of the embodiments generally have similar features, unless specific properties of such like-numbered components are described herein and are understood by a person having skill in the art to be different from other like-numbered components. Still further, to the extent that linear or circular dimensions are used in the description of the disclosed devices and methods, such dimensions are not intended to limit the types of shapes that can be used in conjunction with such devices and methods. A person skilled in the art will recognize that an equivalent to such linear and circular dimensions can easily be determined for any geometric shape. Sizes and shapes of the impact indication devices, and components thereof, can depend at least on the configuration, size, and shape of an object with which they are used, e.g., a face on a head of a golf club.

The present disclosure generally relates to impact indication devices in the form of a patch that can be removably and replaceably attached to a face of a golf club. The patch includes a ball-striking surface that can visually display an impact or ball strike location where the patch, and thus the face of the golf club, most recently struck the ball. In exemplary embodiments, the patch displays a most recent ball strike location without displaying locations of previous ball strikes. This allows a user to more easily determine where the most recent ball strike occurred without having the display obscured by the display of earlier ball strikes. Further, the patch can be configured to "reset" itself to no longer display locations of a previous ball strike by the time or while the most recent ball strike occurs. As a result, no further actions beyond swinging the golf club again is required by the user between ball strikes.

A variety of different innovative features are described herein that allow impact indication devices to achieve the aforementioned capabilities of visually displaying only a most recent ball strike and clearing previous ball strikes with no more than a swing of a golf club. These features can operate in different manners, yet each can be suitable for achieving one or more of the intended purposes.

Impact Indication Device

Figure 1B:
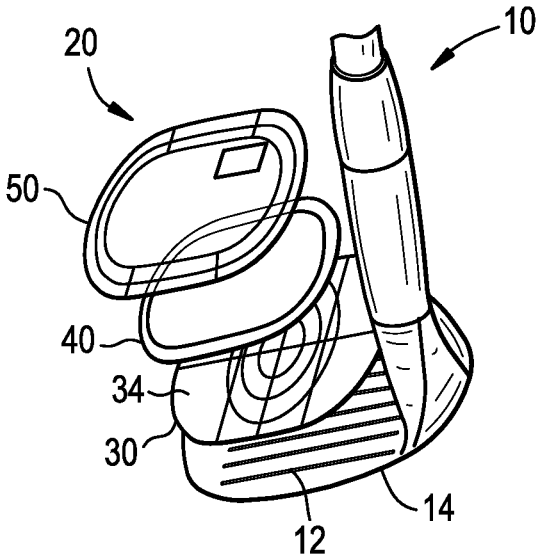
FIG. 1B is an exploded view of the impact indication device of FIG. 1A.
Figure 1C:
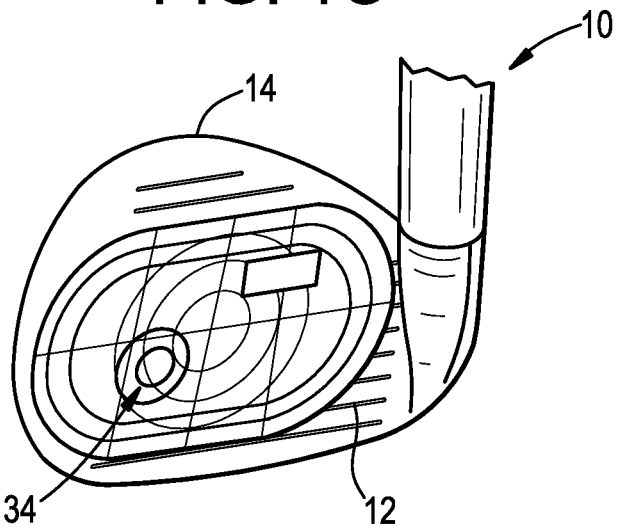
FIG. 1C is a perspective view of the impact indication device of FIG. 1A having a ball strike mark displayed thereon.

One exemplary embodiment of an impact indication device configured to both visually display only a most recent ball strike and be reset to clear previous ball strikes using no more than a swing of a golf club is illustrated in FIGS. 1A-1C. As shown, an impact indication device 20 can be a patch having a plurality of layers 30, 40, 50 that work together to indicate the location of a ball strike. In the illustrated embodiment, the layers include a base layer 30 adhered to a face 12 of a golf club 10, an exposure layer 40 disposed over at least a portion of the base layer 30, and a cover layer 50 disposed over the exposure layer 40 and disposed over at least a portion of the base layer 30.

While each layer is discussed with more particularity at least with respect to FIGS. 2A-8C, generally the base layer 30 includes one or more indicia 34 that provide information to the user related to a location of a ball strike, and the exposure layer 40 includes a material 44 that can be displaced in response to a ball strike to reveal the base layer 30, including, depending on the location of the ball strike, the indicia 34. In one exemplary embodiment the material 44 is a yield-stress material or fluid disposed within a chamber 42 of the exposure layer 40.

The optional cover layer 50 can be adapted to have a variety of features and functions, but in the illustrated embodiment the cover layer 50 includes a generally inelastic membrane 52 configured to provide a rigidity that helps maintain a volume of the chamber 42 of the exposure layer 40 so that the yield-stress material 44 is displaced to expose a portion of the base layer 30 in response to a ball strike. In other embodiments, the exposure layer 40 can be configured to provide rigidity in lieu of a cover layer 50. The exposure layer 40 can have a sufficiently rigid surface such that the surface can help maintain a volume of the chamber 42 to allow the yield-stress material 44 contained therein to be displaced to expose a portion of the base layer 30 in response to a ball strike. As illustrated in FIG. 1C, after a club head 14 of the golf club 10, and more particularly the device 20 disposed on the face 12, strikes a ball, the yield-stress material 44 at the location of the ball strike is displaced, revealing indicia 34 formed on the base layer 30.

Figure 1D:
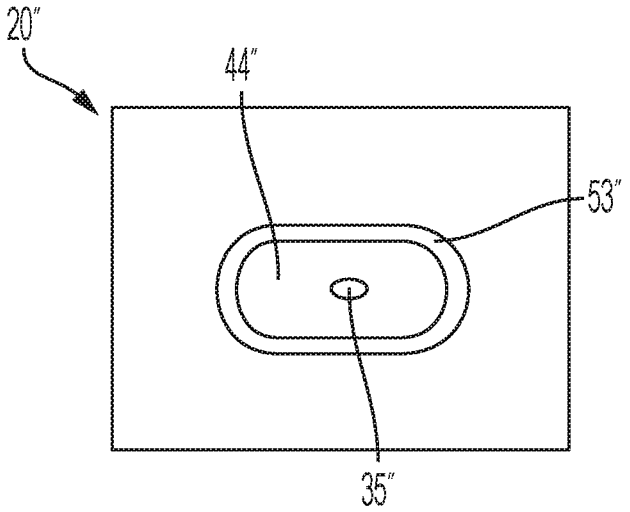
FIG. 1D is a top perspective view of another exemplary embodiment of an impact indication device having a ball strike mark displayed thereon.
Figure 1E:
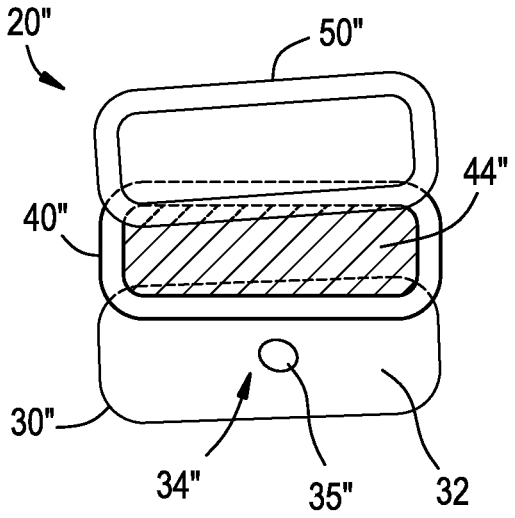
FIG. 1E is an exploded view of the impact indication device of FIG. 1D without the ball strike mark displayed thereon.
Figure 1F:
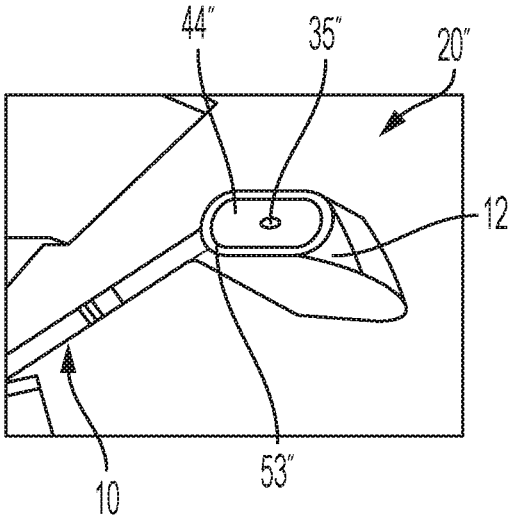
FIG. 1F is a perspective view of the impact indication device of FIG. 1D attached to a golf club.

FIGS. 1D-1F illustrate another exemplary embodiment of an impact indication device 20". As shown, the device 20" includes a base layer 30", an exposure layer 40", and a cover layer 50", and the features of such layers can be consistent with the descriptions of similar layers provided for herein. The base layer 30" includes indicia 34" formed on a display surface 32" of the base layer", as shown a single, circular sweet spot 35" formed in an approximate center of the base layer 30". In one exemplary embodiment, the display surface can be a white color, while the sweet spot 35" can be a yellow color and can have a diameter of about 1 centimeter. The exposure layer 40" includes a chamber 42" having a yield-stress material 44" contained therein, and can be configured to generally cover the indicia 34" of the base layer 30" except at a location where a ball strike is made, as shown in FIGS. 1D and 1F. In one exemplary embodiment, the yield-stress material 44" can be a blue color.

The cover layer 50" can be disposed over the exposure layer 40" and can be sealed to the base layer 30" to help contain the exposure layer 40" and the yield-stress material 44" thereof. As shown, the cover layer 50" is welded to the base layer 30" by a welded ring 53" disposed proximate edges of the base and cover layers 30", 50". As shown in FIG. 1F, the device 20" can be attached to a face 12 of a golf club 10 using any number of techniques, including by including an adhesive on a back side of the base layer 30". FIGS. 1A and 1F illustrate a configuration after a ball strike occurs, in which a portion of the base layer 30" is revealed. As shown, the ball strike is proximate to the sweet spot 35", and thus the yield-stress material 44" flows away from the point of impact upon impact to reveal a portion of the sweet spot 35". A more thorough description of how devices like the device 20" respond to impact is provided below.

Base Layer

Figure 2A:
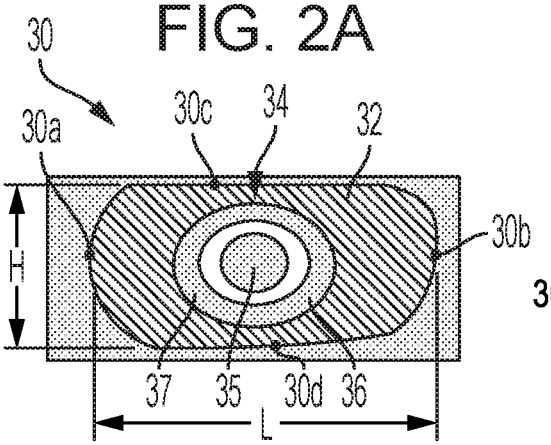
FIG. 2A is a top view of a base layer of the impact indication device of FIG. 1A.

The base layer 30, shown in FIG. 2A, can be generally elliptical in shape and can include indicia 34 formed on a display surface 32 that assist a user in knowing where with respect to the face 12 of the club 10 impact was made with a golf ball. While any number of indicia can be incorporated into the base layer 30 to provide information to a user about the location of impact, the indicia 34 of the illustrated embodiment includes a bulls-eye pattern having an approximate center 35, middle ring 36, and outer ring 37 that are reflective of the location of a club's sweet spot. The indicia 34 can be color-coded so that they contrast with respect to each other. For example, the center 35 can be a green color, the middle ring 36 a yellow color, and the outer ring 37 an orange color, with the rest of the base layer being a color as well, such as red. The colors of the base layer 30 and the indicia 34 can also generally contrast with the color of the yield-stress material 44, e.g., the yield-stress material can be a blue color. The various contrasting colors can make it easy for a user to identify the exact location of impact after a ball strike. In one exemplary embodiment, a diameter of the center 35 can be about 0.75 centimeters, a diameter of the middle ring 36 can be about 1.13 centimeters, and a diameter of the outer ring can be about 1.50 centimeters. A person skilled in the art will recognize a number of ways by which the indicia 34 can be formed on the base layer 30, including by way of non-limiting example, printing or stamping the indicia 34 on the display surface 32.

A back, club head-facing side (not shown) of the base layer 30, which is opposed to the display surface 32, can include any adhesive or other similar material that is configured to allow the base layer 30 to attach to the face 12 of the club. In some exemplary embodiments, the adhesive can be a reusable adhesive, allowing the device 20 to be easily attached to and removed from the club face 12, and even reattached to the same or a different club face. The disclosures herein can be adapted for use on any type of club face, including irons, woods, fairway woods, wedges, and putters. A person skilled in the art will recognize a number of different adhesives that can be used for such a purpose, including, by way of non-limiting example, a polymer-based glue, as well as an amount of adhesive to apply to the back side of the base layer 30 to provide a secure attachment that has a negligible effect on the results of the golf swing.

A shape of the base layer 30 generally can depend, at least in part, on the size and shape of the club on which it is intended to be used and the size and shape of the other components of the device 20, including any other layers. Thus, although in the illustrated embodiment the base layer is substantially elliptical in shape, in other embodiments it can be circular, rectangular, triangular, pentagonal, or a variety of other shapes. A size of the base layer 30 can also depend on the size and shape of the club on which it is intended to be used and the size and shape of the other components of the device 20, including any other layers. In the illustrated embodiment, a length L extending from a first vertex 30*a* to a second vertex 30*b* can be in the range of about 2.5 centimeters (about 1 inch) to about 8.0 centimeters (about 3 inches), and in one exemplary embodiment the length L is about 6.4 centimeters (about 2.5 inches), and a height H extending from a first co-vertex 30*c* to a second co-vertex 30*d* can be in the range of about 1.5 centimeters (0.6 inches) to about 5.0 centimeters (about 2 inches), and in one exemplary embodiment the height H is about 3.2 centimeters (about 1.25 inches). A thickness of the base layer 30 can generally be as thin as possible to minimize any effect the layer 30 has on the strike of the golf ball. In some embodiments a thickness of the base layer 30 can be about 0.8 millimeters or less, and in one exemplary embodiment a thickness can be about 0.5 millimeters. The base layer 30 can be formed from any number of materials, but in some embodiments it can be made from a PET acrylic-backed film, while in other embodiments it can be a plasticized PVC sheet or various types of thermoplastics, such as urethanes, polyesters, polyethylene, polycarbonate, and santoprene.

Figure 2B:
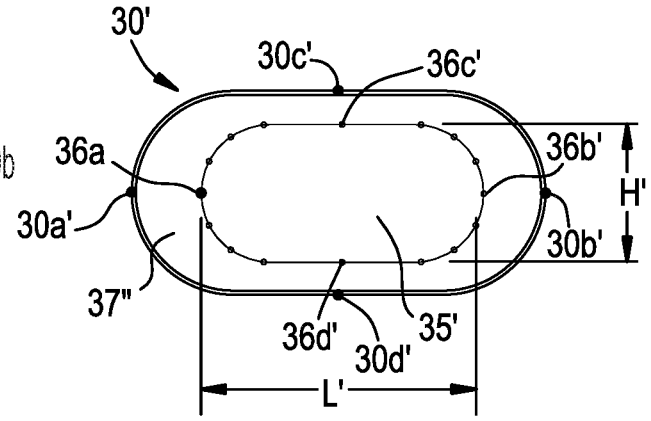
FIG. 2B is a top view of another embodiment of a base layer for use in an impact indication device.

FIG. 2B illustrates an alternative embodiment of a base layer 30' in which the indicia 34' is more elliptical in shape. Similar to the base layer 30, the base layer 30' is substantially elliptical in shape and can be sized similarly, however, the indicia 34' includes an elliptical ring 36' defining a sweet-spot portion 35' and a off-center portion 37'. While a size and shape of the elliptical ring 36' can vary, in one exemplary embodiment the elliptical ring has a length L' extending from a first vertex 36*a*' to a second vertex 36*b*' of about 2.5 centimeters (about 1 inch), and a height H' extending from a first co-vertex 36*c*' to a second co-vertex 36*d*' of about 1.6 centimeters (about 0.625 inches). The embodiments of FIGS. 1A-1C and 2A, 1D-1F, and 2B make it clear that indicia formed on a base layer of an impact indication device can have any number of configurations without departing from the spirit of the present disclosure.

Exposure Layer

Figure 3:
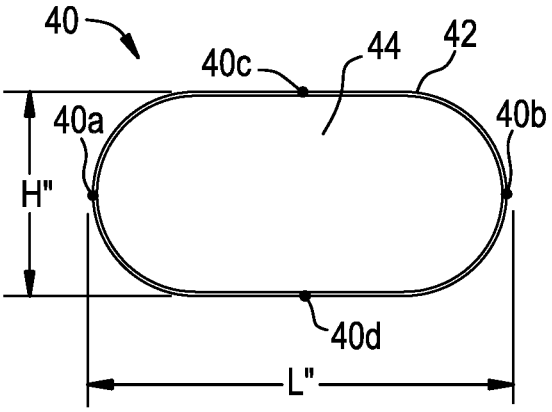
FIG. 3 is top view of an exposure layer of the impact indication device of FIG. 1A.

One exemplary embodiment of an exposure layer 40 is illustrated in FIG. 3. The exposure layer 40 is generally designed to allow displacement of a portion thereof, e.g., the yield-stress material 44, to reveal a portion of the base layer 30, such as some aspect of the indicia 34. The exposure layer 40 can include a chamber 42, which in the illustrated embodiment substantially defines the size and shape of the layer 40. In other embodiments, such as the device 20" illustrated in FIGS. 1D-1F, a chamber (not shown, but outlined by the yield-stress material 44") can be smaller in size than the layer 40" itself.

As shown in FIG. 3, the exposure layer 40 is generally elliptical in shape, although other shapes are possible depending at least on the shape and size of the other components of the device 20 and the face 12 of the club 10 on which the device 20 is configured to be applied. The size of the exposure layer 40 can be generally similar but slightly smaller in size in comparison to the base layer 30. By being slightly smaller in size, the exposure layer 40 can be fit within the confines of the base layer 30 and an optional cover layer 50. In the illustrated embodiment, a length L" extending from a first vertex 40*a* to a second vertex 40*b* can be in the range of about 2.5 centimeters (about 1 inch) to about 8.0 centimeters (about 3 inches), and in one exemplary embodiment the length L" is about 5.8 centimeters (about 2.25 inches), and a height H" extending from a first co-vertex 40*c* to a second co-vertex 40*d* can be in the range of about 1.5 centimeters (about 0.6 inches) to about 5.0 centimeters (about 2 inches), and in one exemplary embodiment the height H" is about 2.8 centimeters (about 1.1 inches). Similar to the base layer 30, a thickness of the exposure layer 40 can generally be as thin as possible to minimize any effect the layer 40 has on the strike of the golf ball. In some embodiments a thickness of the exposure layer 40 can be about 1 millimeters or less, and in one exemplary embodiment a thickness can be about 0.7 millimeters. The exposure layer 40, and more particularly the chamber 42, can be formed from any number of materials, but in some embodiments in which the layer 40 is relatively flexible, it can be made from an elastomer. If the layer 40 is designed to not be flexible, more rigid materials can be used. Likewise, if no cover layer 50 is included, the exposure layer 40 can be similar in size to the base layer 30 so as to form a substantially uniform patch for use as the device 20.

The exposure layer 40 can include a yield-stress material 44 disposed in the chamber 42. The yield-stress material 44 can generally be configured to be a semi-rigid solid when it is not under load, but readily flow under stress. The amount of load or stress required to cause the yield-stress material 44 to readily flow, i.e., the threshold load, can depend on a variety of factors, including the size and shape of the chamber 42 in which the material 44 is disposed, the properties of any components surrounding the chamber 42, the viscosity of the material 44, and the angle at which the load is applied to the material 44. In some embodiments, an approximately direct impact resulting from contact with a golf ball at approximately 48 kilometers per hour (about 30 miles per hour) or more can cause the yield-stress material 44 to flow away from the impact point. A person skilled in the art will understand how to manipulate the variables such as the size and shape if the chamber 42 and the viscosity of the material 44, among others, to achieve a desired threshold load. The desired threshold load is generally a load that will not be achieved by incidental contact with the device 20, but which will be achieved when a golf club is swung to make contact with a ball, even by an amateur or weaker player.

In the illustrated embodiment, a volume of the material 44 is less than a volume of the chamber 42. For example, in some embodiments the volume of the material 44 is in the range of about 80% to about 98% in comparison to the available volume of the chamber 42. In one exemplary embodiment, about 95% of the chamber 42's volume is filled with the yield-stress material 44. The amount of material 44 can end up being in the range of about 0.5 milliliters to about 4 milliliters, and in one exemplary embodiment is about 0.8 milliliters. Generally there should be enough material 44 in the chamber 42 that the base layer 30 is not visible when the material 44 in the exposure layer 40 has not been displaced. In some exemplary embodiments, air in the chamber 42 of the exposure layer 40 can be vacuumed out, thereby helping the device 20 to have the capability of resetting itself, as described in further detail herein.

The yield-stress material 44 can be any number of materials that are capable of being a semi-rigid solid under gentle or no load, but capable of readily flowing above a threshold load. Synthetic clays and hyrdrogels, which can both gel through a charge stabilization process, are two forms of materials that are useful in the device 20. In one exemplary embodiment, the yield stress material 44 can include Laponite XLG, which is a synthetic clay manufactured by Rockwood Additives Limited, Moorfield Road, Widnes, Cheshire WA8 OJU, United Kingdom. Various formulations of the yield-stress material can be used, but in one exemplary embodiment, 5% Laponite XLG synthetic clay is disposed in tap water, while in another exemplary embodiment 10% Laponite XLG synthetic clay is disposed in tap water. Such formulations can be generally transparent, and thus can be colored using any number of techniques known to those skilled in the art. In one exemplary embodiment, the material 44 used in the device 20 is a blue color created by mixing a 5% titanium dioxide with trace amounts of carbon black and a few drops of blue food coloring.

In addition to being generally transparent, Laponite XLG synthetic clay can be an advantageous yield-stress material because it can generally have sharp yield-stress transitions and high-shear-rate viscosities, which allows the material 44 to readily flow in response to the threshold load and stabilize shortly thereafter. When it stabilizes, it can maintain the configuration that resulted from the threshold load, and thus the impact location causing the threshold load can be maintained. Generally, the material 44 selected can be temperature agnostic, although to the extent temperature does affect the threshold load of the material 44, a person skilled in the art can adjust parameters such as those previously mentioned to achieve the desired threshold load.

Cover Layer

Figure 4:
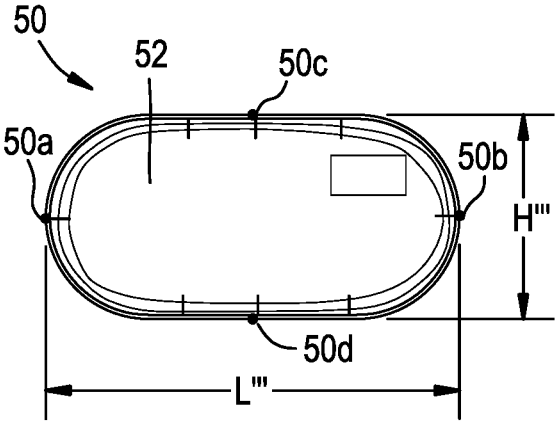
FIG. 4 is a top view of a cover layer of the impact indication device of FIG. 1A.

An optional cover layer 50 of the device 20 is shown in FIG. 4. In the illustrated embodiment, the cover layer 50 includes a generally inelastic membrane 52 that is configured to provide rigidity to help maintain a volume of the chamber 42 of the exposure layer 40 so that the material 44 within the chamber 42 is displaced to expose a portion of the base layer 30 in response to a ball strike. As shown, the cover layer 50 is generally elliptical in shape, although other shapes are possible depending at least on the shape and size of the other components of the device 20 and the face 12 of the club 10 on which the device 20 is configured to be applied. The size of the cover layer 50 can generally be the same in size or slightly larger than the exposure layer 40 so that the cover layer 50 can provide a rigid surface against the entirety of the exposure layer 40. In some exemplary embodiments, such as the devices 20 and 20" illustrated in FIGS. 1A-1C and 1D-1F, the cover layer 50, 50" has the same dimensions as the base layer 30, 30" to create a seal around the exposure layer 40, 40" and form a singular patch for use as the device 20, 20". Accordingly, in the illustrated embodiment, a length L''' extending from a first vertex 50*a* to a second vertex 50*b* can be in the range of about 2.5 centimeters (about 1 inch) to about 8.0 centimeters (about 3 inches), and in one exemplary embodiment the length L''' is about 6.4 centimeters (about 2.5 inches), and a height H''' extending from a first co-vertex 50*c* to a second co-vertex 50*d* can be in the range of about 1.5 centimeters (about 0.6 inches) to about 5.0 centimeters (about 2 inches), and in one exemplary embodiment the height H''' is about 3.2 centimeters (about 1.25 inches). Similar to each of the layers 30, 40, a thickness of the cover layer 50 can generally be as thin as possible to minimize any effect the layer 50 has on the strike of the golf ball. In some embodiments a thickness of the cover layer 50 can be about 0.8 millimeters or less, and in one exemplary embodiment a thickness can be about 0.5 millimeters.

The cover layer 50 can be formed from any number of materials, but in some embodiments its generally inelastic membrane is made from polyvinyl acetate. In other embodiments it can be made from the same material as the base layer, such as a PET acrylic-backed film or a plasticized PVC sheet. In other embodiments it may be more desirable for the cover layer 50 to more easily withstand high velocities without splitting. In such embodiments, materials having more elasticity, and thus have better tensile resistance, may be used, including but not limited to thermoplastic rubbers, urethanes, polyesters, polyethylene, polycarbonate, and santoprene. Generally, the cover layer 50 is substantially transparent so that the base layer 30 and its indicia 34 can be easily visible through the cover layer 50 and the displaced exposure layer 40.

In some embodiments, the cover layer 50 can include one or more indicia formed thereon using techniques known to those skilled in the art, such as printing or stamping. For example, the indicia can be tailored to match particular types of golf club heads (e.g., irons, woods, fairway woods, wedges, putters) and/or particular brands of golf club heads (e.g., Callaway, Ping, Taylor Made, Nike) to help a user know precisely where the device 20 should be placed on the face 12 of the club 10 so that it properly aligns with the sweet spot of the club 10. In other embodiments, indicia formed on the cover layer 50 may provide feedback to a user regarding the location of a ball strike.

Impact Indication Device in Use

Figure 5A:
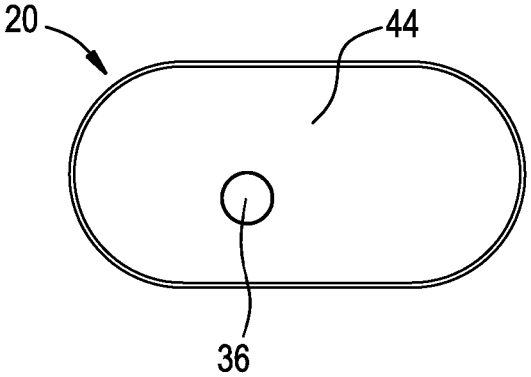
FIG. 5A is a top view of the exposure layer of FIG. 4 disposed over the base layer of FIG. 2A, illustrating a ball strike indication.
Figure 5B:
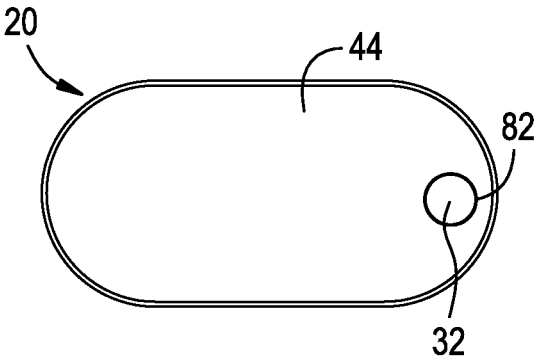
FIG. 5B is a top view of the exposure layer of FIG. 4 disposed over the base layer of FIG. 2A, illustrating another ball strike indication.

FIGS. 5A and 5B illustrate one exemplary embodiment of two separate impact locations formed on the device 20. As shown in FIG. 5A, a first impact location 80 is formed when load applied by the golf club head 12, and thus the device 20 disposed thereon, to a golf ball being struck exceeds the threshold load. The impact of the ball strike causes the yield-stress material 44 to shear and flow away from the impact location 80, thereby exposing the middle ring 36 of the base layer 30. After the contact is complete and the material 44 is displaced to its new location, the material 44 again settles into its semi-rigid solid state, with the impact location 80 still visible.

Following a second ball strike, a second impact location 82 is formed. As shown by comparing FIG. 5B to FIG. 5A, the second impact location 82 is at a different location on the device 20 than the first location 80, with the second location 82 revealing a portion of the display surface 32 of the base layer 30 that is outside of any of the indicia 34. By the time the second ball strike is complete, the first impact location 80 is no longer visible. This is because the material 44 displaced at the second impact location 82 flows to the other portions of the exposure layer 40, including the area previously exposed by the first strike. A person skilled in the art will recognize that had the second impact location intersected at all with the first impact location, then the portions that intersected would have remained exposed after the second ball strike as well. Thus, the yield-stress material 44 only flows back to portions of the first impact location 80 in the exposure layer 40 that do not overlap with portions of the second impact location 82 in the exposure layer 40.

Figure 6A:
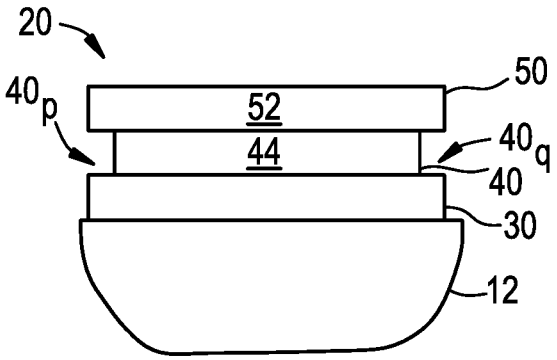
FIG. 6A is a schematic cross-section view of the impact indication device of FIG. 2A prior to a first ball strike.
Figure 6B:
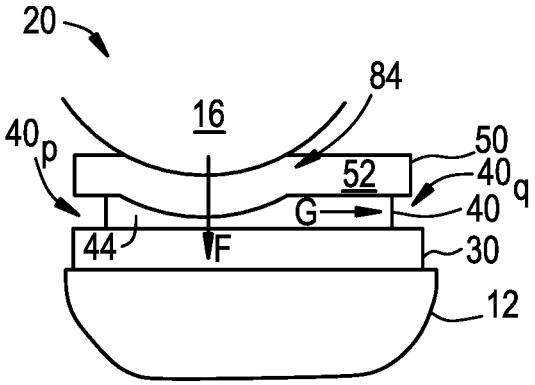
FIG. 6B is a schematic cross-section view of the impact indication device of FIG. 6A during a first ball strike.

FIGS. 6A-6D provide an alternative illustration of the device 20 responding to two separate ball strikes, highlighting the displacement of the substantially inelastic cover layer 50 and the exposure layer 40 in response to the ball strikes. As shown in FIG. 6A, the base layer 30 is attached to the club head face 12, the exposure layer 40 is disposed over the base layer 30, and the cover layer 50 is disposed over the exposure layer 40. Prior the any impact, each layer 30, 40, and 50 has a substantially uniform thickness. During a first ball strike, however, both the cover layer 50 and the exposure layer 40 can be displaced, as shown in FIG. 6B by a ball 16 first contacting the cover layer 50 when the golf club on which the face 12 is disposed is swung. The cover layer 50, which can be substantially inelastic, can be displaced in a direction F, toward the club face, at the location of the first ball strike. The yield-stress material 44 of the exposure layer 40, on the other hand, is configured to displace to the available volume in the layer 40 due to the volume of the material 44 being less than the available volume of the chamber 42, along with the vacuum contained therein. The displacement of the yield-stress material 44 is generally illustrated by an arrow G, although a person skilled in the art will recognize that the material 44 will generally flow to open volume of the chamber 42 as it flows away from a point of impact 84 where the ball 16 struck. In the illustrated embodiment, as demonstrated by the fact that the arrow G does not extend outside of the exposure layer 40, a person skilled in the art will understand that the material 44 can be prevented from flowing out either of sides 40*p*, 40*q* of the exposure layer 40 relying upon a number of different configurations. For example, the sides 40*p*, 40*q* can be sufficiently rigid and non-porous so as to prevent the material 44 from flowing therethrough. In other embodiments, the cover layer 50 and base layer 30 can be coupled together to secure the exposure layer 40 therebetween.

Figure 6C:
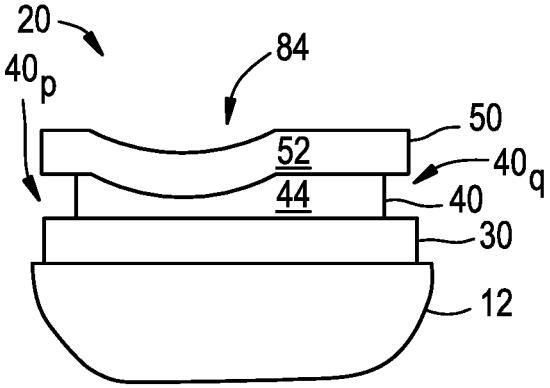
FIG. 6C is a schematic cross-section view of the impact indication device of FIG. 6B after the first ball strike.
Figure 6D:
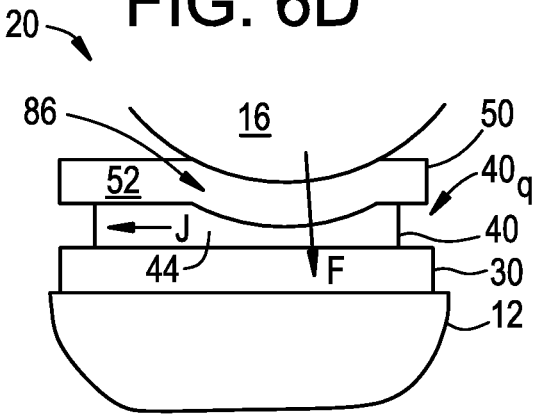
FIG. 6D is a schematic cross-section view of the impact indication device of FIG. 6C during a second ball strike.
Figure 7:
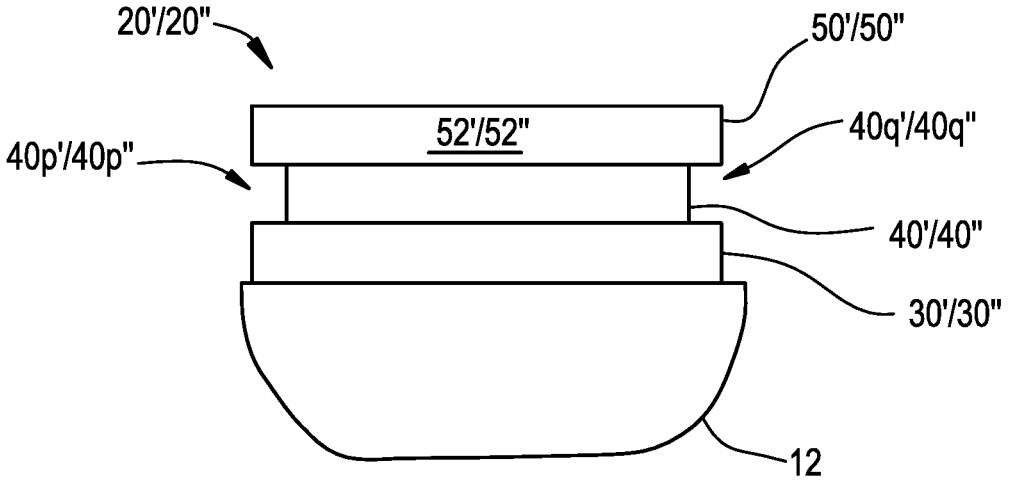
FIG. 7 is a schematic cross-section view of another exemplary embodiment of an impact indication device attached to a face of a golf club.
Figure 8A:
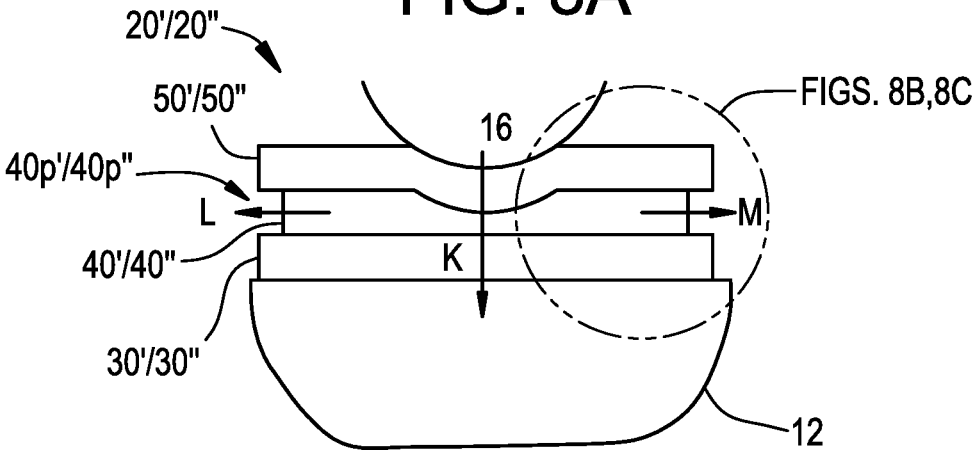
FIG. 8A is a schematic cross-section view of the impact indication device of FIG. 7 during a first ball strike.
Figure 8B:
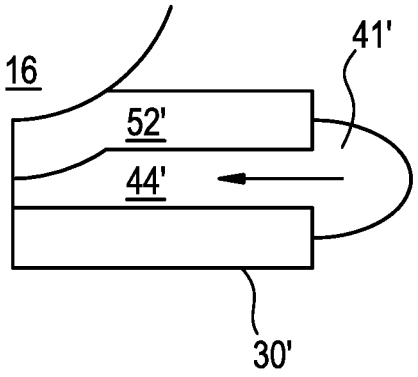
FIG. 8B is a schematic, detailed, cross-section view of a portion of the impact indication device of FIG. 8A during the first ball strike.
Figure 8C:
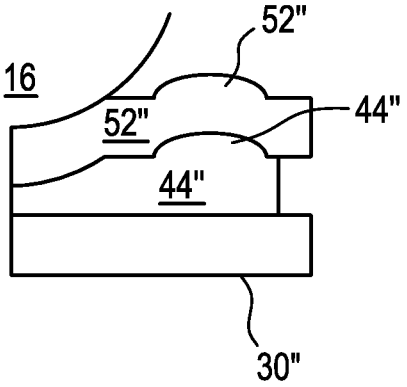
FIG. 8C is a schematic, detailed cross-section view of the portion of the impact indication device of FIG. 8B during a second ball strike.

As shown in FIG. 6C, after the first strike is complete, the cover layer 50 can remain displaced at the first point of impact 84 due, at least in part, to its inelastic membrane 52, and the yield-stress material 44 can likewise remain displaced because it is configured to return to a semi-rigid state after it shears in response to the threshold load. A second ball strike 86, shown in FIG. 6D, however, can displace both the cover layer 50 and the exposure layer 40. As shown, the ball 16 strikes the cover layer 50 when the golf club on which the face 12 is disposed is swung. The cover layer 50 can be displaced again in the direction F, but at the location of the second ball strike. The yield-stress material 44 of the exposure layer again displaces to the available volume in the layer 40, which includes volume created as the portion of the cover layer 50 at the first ball strike location returns to its original state. Again, although the displacement of the yield-stress material 44 is generally illustrated by an arrow J, a person skilled in the art will recognize that the material 44 will generally flow to open volume of the chamber 42 as it flows away from the point of impact where the ball 16 struck during the second strike.

With each strike of a golf ball, the cover layer 50 and exposure layer 40 can be displaced in a manner as described and illustrated herein. Although a ball strike impact is left formed in the device 20 leading into the next ball strike, the displacement of the cover layer 50 and the exposure layer 40 can have a negligible effect on the subsequent ball strike, particularly in view of the very thin nature of the device 20. Each time a ball strike occurs, that action alone can be enough to reset or essentially eliminate the mark left by the previous ball strike, except to the extent one ball strike overlaps with the other. As a result of these capabilities, a user can continue to swing the golf club, notice the impact location after each swing, make any desired adjustments to his or her swing, and then swing again without taking the time to manually remove the impact location mark from the device 20 or strain to determine which impact location mark was the most recent mark because the device 20 only displays the most recent impact location. In some embodiments, a device can be used for at least 20 swings, at least 80 swings, and possibly up to approximately 100 swings.

It may be desirable to build-in safety measures to the device 20 that cause some sort of failure in the device before wear-and-tear from using the device breaks the exposure layer 40 and causes the yield-stress material 44 to eject from the device 20. For example, the device 20 can be configured to gradually fail such that once the exposure layer 40 has sufficiently worn, any failure will be small and not lead to an undesirable explosion of fluid out of the device 20. Alternatively, the cover layer 50, or top, visible surface of the exposure layer 40 when no cover layer is included, can be configured to wear, e.g., scuff, after each use such that after a certain number of uses, it becomes difficult to see the exposed base layer 30 and indicia 34 through the cover layer 50. In still other embodiments, an inner membrane having a fluid formed therein can be disposed within the device, 20, for example within the chamber 42 of the exposure layer, and can be configured to fail prior to failure by the exposure layer 40. When the inner membrane fails, the fluid contained therein can seep into the exposure layer, or elsewhere in the patch, thereby notifying the user that the device 20 should be replaced. The inner membrane and fluid disposed therein can be configured such that they do not interfere with viewing until the inner membrane fails. In still further embodiments, a use tracking mechanism that begins one color and fades away as the device 20 is used can be included to help the user keep track of when it is time to replace the device 20. In still other embodiments, the device 20 can be configured to include a reservoir that is connected to the exposure layer 40, with a path therebetween configured to open only after the exposure layer 40 fails. Thus, if the exposure layer 40 fails, the material 44 can flow into the reservoir.

Sensors

Figure 9A:
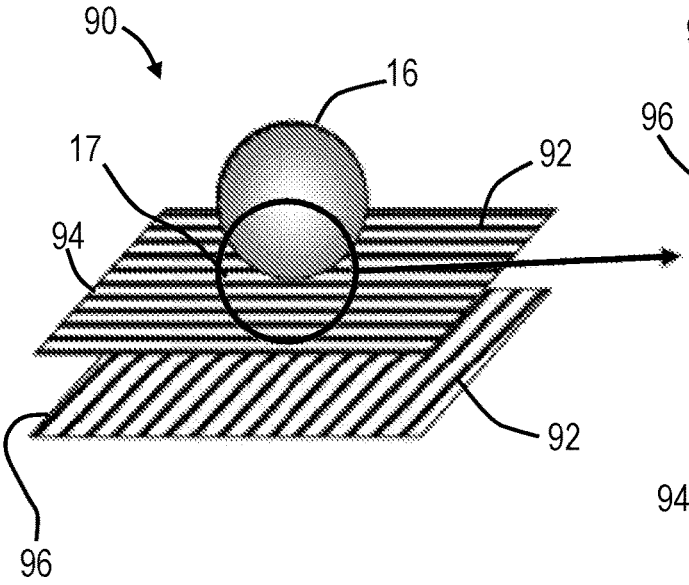
FIG. 9A is a schematic perspective view of one exemplary embodiment of an electronic sensor for use in an impact indication device.
Figure 9B:
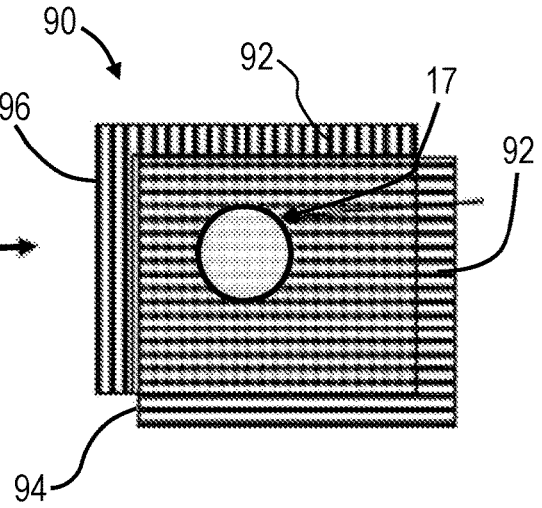
FIG. 9B a schematic top view of the electronic sensor of FIG. 9A.

In some embodiments, one or more sensors can be associated with an impact indication device. The sensor(s) can have a variety of configurations and generally be adapted to measure any number of parameters, including but not limited to a contact pressure and a location of a ball strike. In one exemplary embodiment, illustrated in FIGS. 9A and 9B, a sensor 90 can be a simple flexible circuit. As shown, a network of crossing wires 92 formed on two opposed flexible sheets 94, 96 can be used to help determine at least a location of a ball strike. A person skilled in the art will recognize that such a determination can be made, for instance, through isolation of short-circuits between the sheets 94, 96 due in part to the flow of yield-stress material.

The sensor 90 can also be configured to make other determinations, such as a force of impact, for instance by using an elastomeric support. As illustrated, a contact zone 17 that results from the impact of a golf ball 16 is where the isolated short circuits can make the desired determinations. The sensor 90 can be disposed on any layer of an impact determination device, and can even be disposed separately on a face or head of a golf club. In one exemplary embodiment, such as the device 20, the sensor can be disposed on a back side of the cover layer 50. A person skilled in the art will understand various other types and configurations of sensor(s) that can be adapted for use with the impact indication devices disclosed herein.

Methods of Manufacture

Figure 10A:
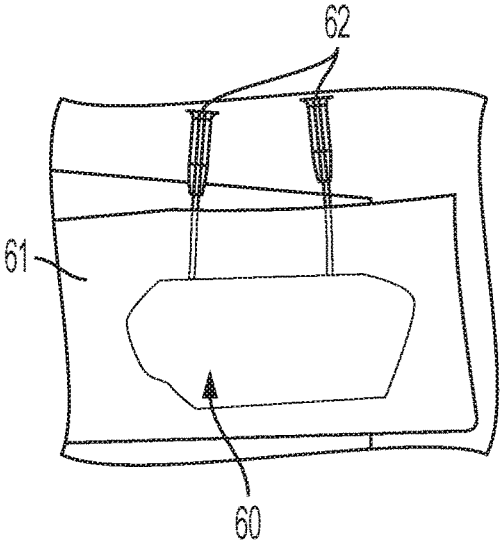
FIGS. 10A-10J are sequential views of one exemplary embodiment of a method for manufacturing the impact indication device of FIG. 1A.
Figure 10B:
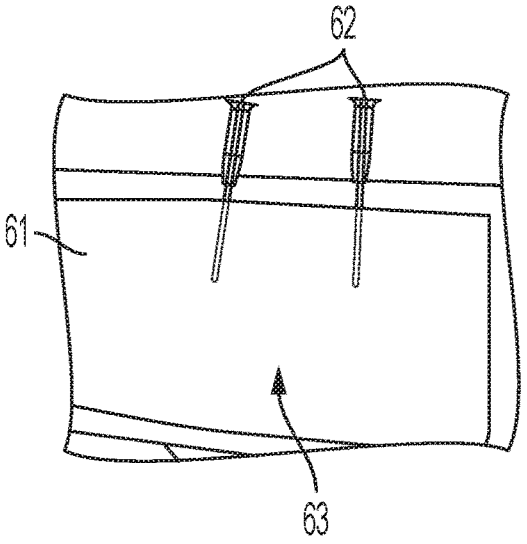

Any number of methods of manufacturing known to those skilled in the art can be adapted to manufacture impact indication devices disclosed herein. In one exemplary embodiment, which begins at FIG. 10A, a template 60 for determining a size of an impact indication device can be disposed between two silicone spacers 61, such as 0.79 millimeter medium soft elastomers. As shown, two needles, such as 25G needles 62, can also be disposed between the spacers 61. The needles 62 can be used to fill a cavity 63 formed by the spacers 61, and also to allow air to escape, as described below. The size of the template 60 with respect to the silicone spacers 61 can be noted, and, as illustrated in FIG. 10B, the template 60 can be subsequently removed.

Figure 10C:
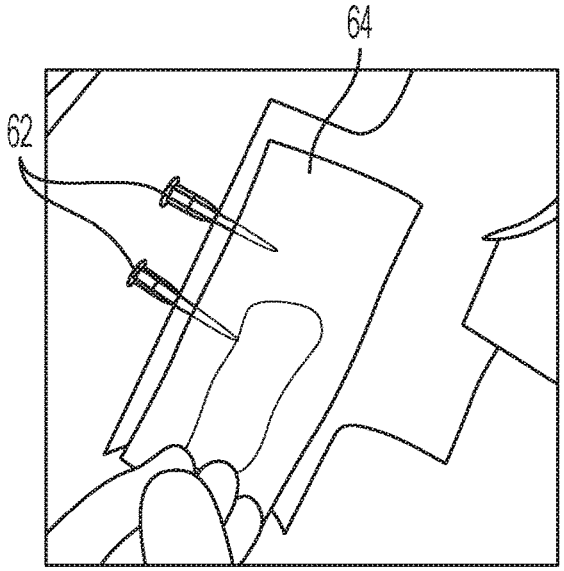
Figure 10D:
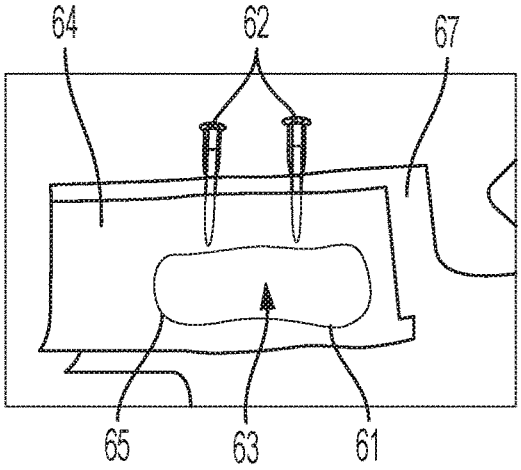
Figure 10E:
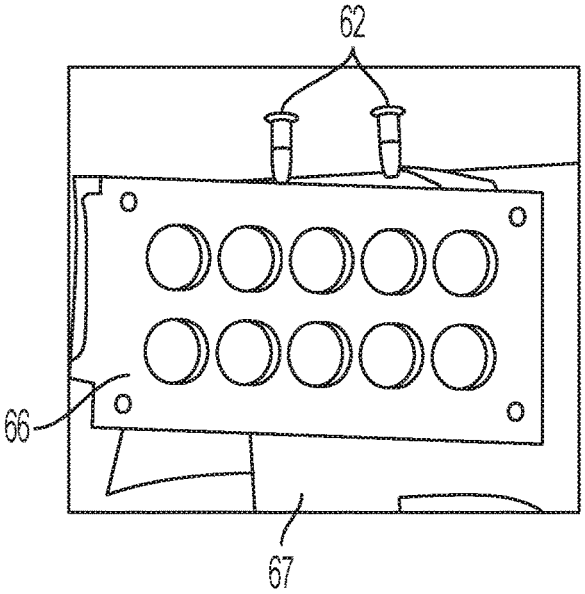

As shown in FIG. 10C, a thin PET film 64 can be disposed adjacent to the spacers 61 and cut to a size similar to that of the previously provided template 60. The thin PET film will eventually be configured to form a base layer of the impact indication device. The spacers 61 can be sealed so as to seal the cavity 63 formed therebetween, although the seal is kept clear of the needles so the needles 62 can still be configured to communicate with the cavity 63. In the embodiment illustrated in FIG. 10D, a bead of heat-sealing adhesive 65 can be used to form the seal of the cavity 63. A weight 66 can then be applied to the construct, thereby sealing the PET film 64 onto an adhesive backing 67. As discussed herein, the adhesive backing 67 can be configured to allow the resulting device to be removably and replaceably attached to a face of a golf club. The weight 66 illustrated in FIG. 10E is in no way limiting as to how weight can be applied to the construct. Any number of weights or mechanisms to apply weight to a construct can be used for this step.

Figure 10F:
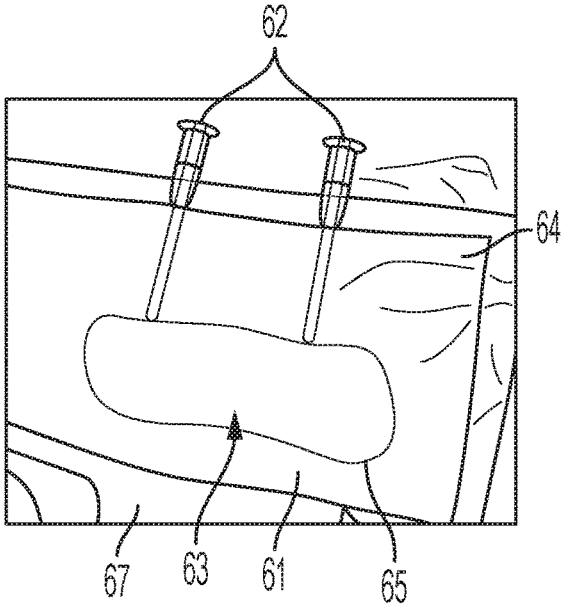
Figure 10G:
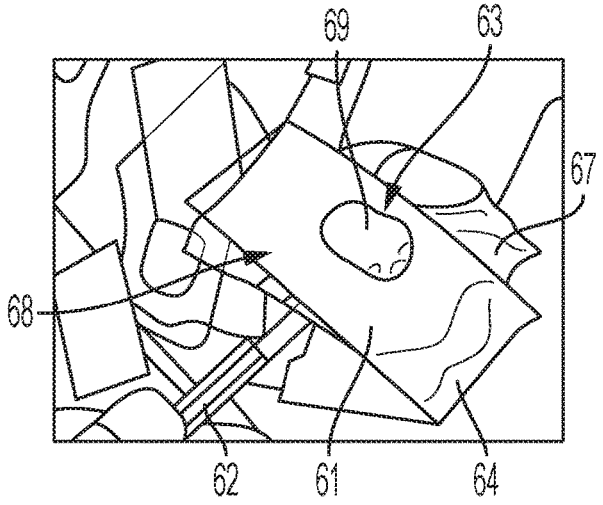
Figure 10H:
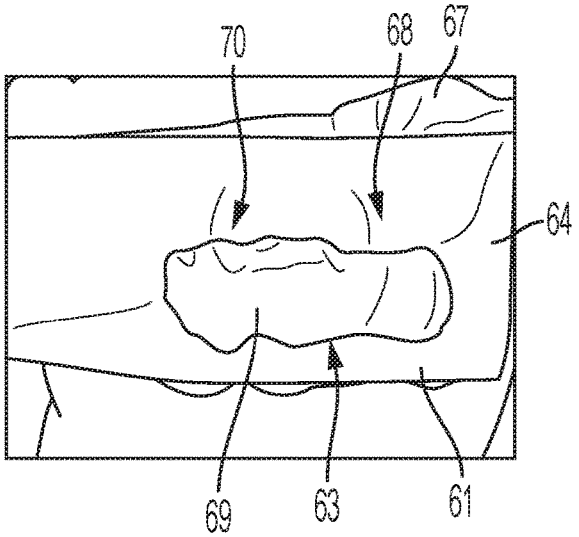

As shown in FIG. 10F, the weight 66 can be removed, and the result is a construct in which the cavity 63 is sealed and just the needles 62 are clear of the hot-glue adhesive bead 65. A vent hole 68 for the cavity 63 can be provided, for instance by removing one of the needles 62, as illustrated in FIG. 10G. The remaining needle 62 can then be used to dispose a yield-stress material 69 such as the materials described herein in the cavity 63. As discussed herein, in some embodiments it can be desirable for the volume of the cavity 63 to exceed the volume of material 69 disposed therein, and thus the material 69 may not necessarily fully fill the cavity 63. Subsequently, the remaining needle 62 can be removed to expose a fill hole 70, and as shown in FIG. 10H, the vent and fill holes 68, 70 can be sealed to create a sealed construction. The seal can be performed using any number of adhesives known to those skilled in the art, for example a glue gun or welding. In embodiments where it is desired, a vacuum (not shown) can be applied to the cavity 63 so that the extra volume in the cavity 63 is not filled with air. More particularly, the silicon spacers 61 can be collapsed on the material 69 so that its natural resting condition is contacting the underlying substrate.

Figure 10I:
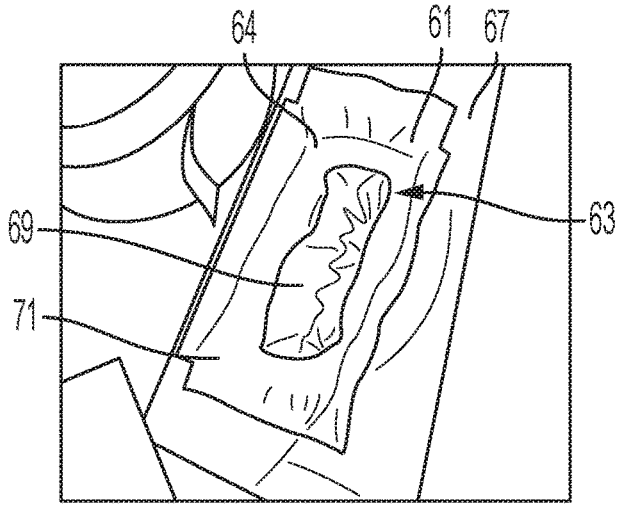
Figure 10J:
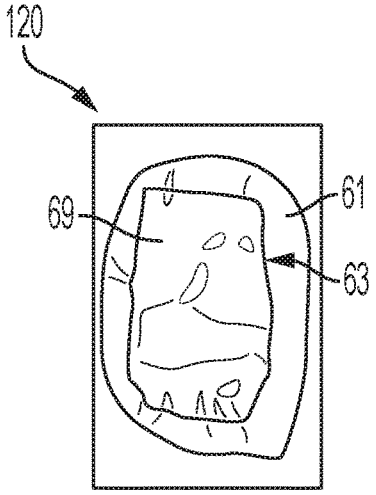

As shown in FIG. 10I, the adhesive backed PET film 64, can be stuck to another adhesive, as shown tape 71, which in turn can be stuck to an adhesive backed silicone elastomer 72 with release liner. Excess materials can be cut-off, resulting in an impact indication device 120. Referring to terms used herein, in the resulting construct, the PET film 64 with adhesive backing can be similar to the base layer 30, the silicon spacers 61 having the yield-stress material 69 disposed therein can be similar to the exposure layer 40, and the adhesive backed silicone elastomer 72 with release liner can be the cover layer 50. A person skilled in the art will recognize that the steps provided for herein are just examples, and many other steps can be adapted for use in forming the impact indication device 120 and other impact indication devices provided for herein. Furthermore, although in this embodiment the resulting exposure layer is formed by way of a heat seal, other sealing strategies can also be used, including those used in the medical, industrial, and food industries.

In still other embodiments the exposure layer can be formed using various thermoform methods known to those skilled in the art. In still other embodiments, the entire device can be manufactured using a conveyor system. For example, a welder can be used to create seals as described, with needles for accessing the cavity already disposed therein. The part can then move on the belt to a fill station, where the yield-stress material can be added into the cavity through the needles. The part can subsequently move to a location where the adhesive backing can be attached and a location where the needles can be removed and openings in which they were disposed sealed, and finally the part can be moved to a die cutter for final formation of the product. A person having skill in the art would understand how other steps, including those known to those skilled in the art and those disclosed herein, can be included in such a system without departing from the spirit of the present disclosure.

Figure 11:
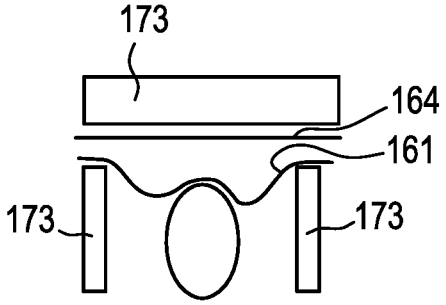
FIG. 11 is a schematic view of another exemplary embodiment of a method for manufacturing an impact indication device.

Another exemplary method for forming an impact indication device is illustrated in FIG. 11. As shown, a flexible transparent film or membrane 161 can be heat sealed or ultrasonically welded to a supporting, semi-rigid layer 164. At this point the unit can be empty but hermetically sealed, for instance by using an ultrasonic welder 173. The unit can then be pumped down and back-filled with a yield-stress material 169 (not shown) through the semi-rigid layer 164 such that no air remains, and then the pump-hole closed and sealed. Again referring to terms used herein, in the resulting construct, and the semi-rigid layer 164 can be similar to the base lawyer 30, the flexible transparent film or membrane 161 can be similar to exposure layer 40. A person skilled in the art will again recognize other variations with respect to this method for forming impact indication devices provided for herein without departing from the spirit of the present disclosure. Further, to the extent this method is illustrated and not described, a person skilled in the art will understand how heat sealing or ultrasonic welding can be used to manufacture impact indication devices in accordance with the present disclosure.

Other Impact Indication Device Embodiments

Figure 12A:
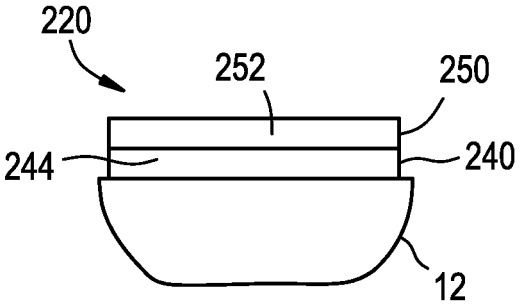
FIG. 12A is a schematic cross-section view of another exemplary embodiment of an impact indication device prior to a ball strike.

Another way in which impact indication devices can visually display only a most recent ball strike and clear previous ball strikes with no more than a swing of a golf club can be by using a porous or deformable substrate. As shown in FIG. 12A, in one exemplary embodiment of an impact indication device 220, an exposure layer 240 that includes a porous or deformable substrate 244 can be attached to a golf club face 12 and a cover layer 250 can be disposed over the substrate 244. The substrate 244 can be made of a variety of materials, but in some exemplary embodiments it can be a simple sponge, a hydrogel, such as a highly porous hydrogel, an elastomer, or foam, such as a low durometer foam, and each can be fully impregnated with a colored fluid configured to generally appear colored until compressed.

Figure 12B:
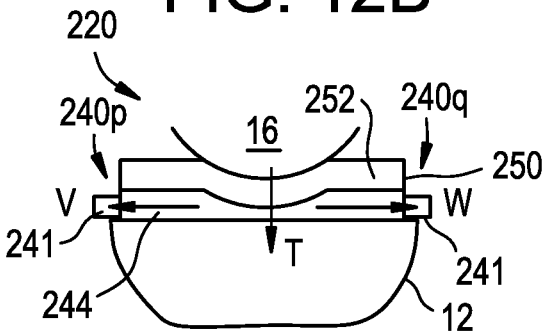
FIG. 12B is a schematic cross-section view of the impact indication device of FIG. 12A during a ball strike.

When the substrate 244 is fully compressed, for instance when a ball 16 impacts the face 10 via the cover 250 and drives the cover 250 and substrate 244 approximately in a direction T as shown in FIG. 12B, the fluid in the substrate 244 at the location of impact can be driven out of the substrate 244 in the directions V and W, towards ends 240*p*, 240*q* of the exposure layer 240 and the original color of the substrate 244 can dominate the appearance at the location of impact. After the strike is complete, the colored fluid driven out of the substrate can seep back into the substrate 244. The rate of recovery can be controlled by a number of parameters, including but not limited to a permeability and uptake of the substrate 244. Once recovery is complete, the location of impact is no longer visible, and a subsequent strike will reveal a new location of impact specific to the most recent strike.

In an alternative embodiment, the impact of a ball can actually drive fluid into a porous substrate, thereby identifying the location of impact by the addition of color to that location. After the ball strike is complete, the fluid can dissipate from the location and spread more evenly through the exposure layer. In this embodiment, the resulting indication of a ball strike can be a fuller, more robust color due a color fluid being driven in to the impact location.

Figure 13A:
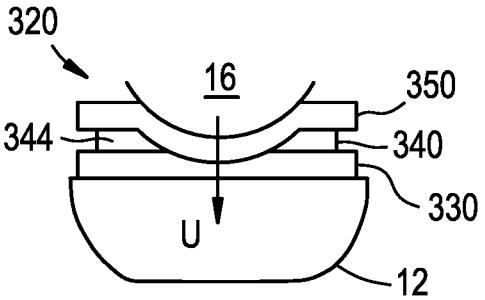
FIG. 13A is a schematic cross-section view of still another exemplary embodiment of an impact indication device during a ball strike.
Figure 13B:
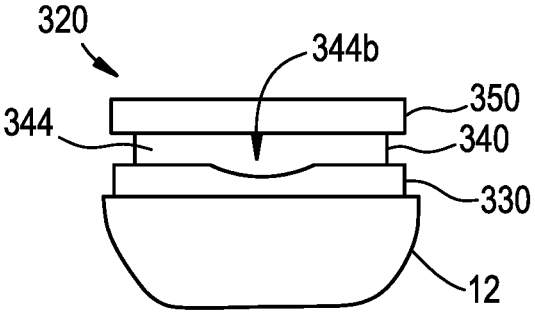
FIG. 13B is a schematic cross-section view of the impact indication device of FIG. 13A after the ball strike.

FIGS. 13A and 13B provide yet another embodiment of an impact indication device 320. The device 320 can visually display only a most recent ball strike and clear previous ball strikes with no more than a swing of a golf club by using a gap mediated configuration in cooperation with a viscoelastic fluid. In the illustrated embodiment, a base layer 330 can be attached to a golf club face 12, an exposure layer 340 having a viscoelastic fluid 344 disposed therein can be disposed over at least a portion of the base layer 330, and a cover layer 350 can be disposed over the exposure layer 340, the exposure layer 340 creating a gap between the base layer 330 and the cover layer 350. In some embodiments the base layer 330 can include a substrate and the cover layer 350 a membrane. When a club is swung and the club face 12 makes contact with a ball 16, via the device 320, the impact can drive the cover layer 350 toward the face 12 in an approximate direction U. In the illustrated embodiment, the cover layer 350 is driven through the exposure layer 340 and into the base layer 330.

After the strike is complete, as shown in FIG. 13B, the cover layer 350 can be substantially elastic, and thus can recover rather quickly. However, the properties of the viscoelastic fluid 344 are such that recovery to return to its initial state takes a little time. As shown, during that time, an excess bulge 344*b* of the fluid 344 exists where the ball strike was located, and thus until the fluid 344 recovers, the increased gap between the cover layer 350 and base layer 330 can look darker to identify the impact location. While or after the viscoelastic fluid 344 recovers, a subsequent ball strike will again cause same chain of events, but the previous ball strike will not longer be visible as the viscoelastic fluid 344 now moves and recovers in response to the latest ball strike. In other embodiments involving a viscoelastic fluid, it may be possible to drive such the fluid disposed in an exposure layer away from an impact zone, toward the edges of the exposure layer, for subsequent recovery. After the strike and during the recovery, the portion exposed by the driven away viscoelastic fluid can be visible to the user as the most recent ball strike location until the viscoelastic fluid completes its recovery.

Figure 14:
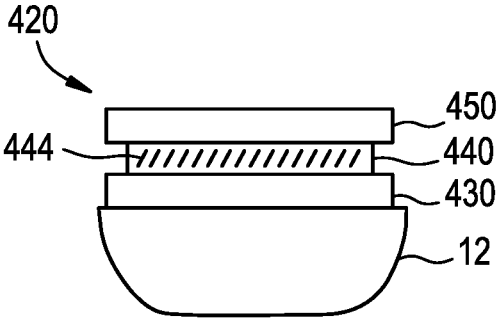
FIG. 14 is a schematic cross-section view of yet another exemplary embodiment of an impact indication device.

In still another embodiment in which an impact indication device is adapted to both visually display only a most recent ball strike and clear previous ball strikes with no more than a swing of a golf club, the device can include liquid crystal films. More particularly, as shown in FIG. 14, the device 420 can include a base layer 430 attached to a golf club face 12, an exposure layer 440 disposed over the base layer 430 and having a plurality of liquid crystal films 444 disposed therein, and a cover layer 450 disposed over the exposure layer 440. The films 444 can be configured to change color to reflect a location of a ball strike, thereby contrasting against those other films that did not change color because they were no impacted by a ball strike.

More particularly, the liquid crystal films 444 work by induced orientation in semi-rigid molecules. This orientation imposes a characteristics length on the self-organized structure contained in the exposure layer 440 that selectively passes specific wavelengths of light. The microstructure of the liquid crystal films can help provide the desired contrast. In one exemplary embodiment, the liquid crystal films are thermochromic liquid crystals, which can use the chiral nematic, sometimes referred to as cholesteric, nature of the self-assembled structures to create an optically active material that is sensitive to temperature. Thermochromic liquid crystals can be made that are either temperature sensitive, i.e., color varies with temperature, or temperature insensitive, i.e., shear-sensitive, which can have a sharp, single color transition. The color changes can be thin-film effects and in bulk the materials can tend to appear iridescent, rather than nomochromatic. In temperature insensitive materials, the transition can be more marked as a "clearing point" where the liquid crystal transitions from a strong reflecting cholesteric phase to a transparent, isotopic phase.

Mobile Impact Recorder

In some instances, an affordable, convenient, and user-friendly mobile technology can be used in conjunction with the impact indication devices provided for herein, or with other impact indication devices known to those skilled in the art, to capture and record where the club face impacts the ball. More broadly, a mobile impact recorder can be provided for recording any number of parameters of a golf swing, and can be used independent of or in conjunction with an impact indication device.

In some exemplary embodiments of a mobile impact recorder, it can be used to capture specific information about the swing and impact of the club face on a struck golf ball. The information can be captured by an accelerometer designed for that purpose, or a number of other components configured to capture such information. A sensor can be designed to record a variety of data parameters, including but not limited to a swing plane, location of impact, angle of impact, and club head speed through. Such parameters can be recorded using a variety of techniques, but in one instance they are detected through vibrations caused by the impact using an accelerometer combined with a sensor and Wi-Fi technology. The parameters can then be used to project a distance and direction of the ball flight, among other results. Alternatively, or additionally, the sensor can be configured to transmit data to a custom receiver, for example, via Bluetooth, conveniently placed on the golf club, golf bag, or other nearby location. The custom receiver can transmit data onto the user's respective smartphone and/or tablet apps in real time. Data can be stored in the cloud for further analysis by the individual golfer or can be shared with a golf instructor. Data can be saved, shared or deleted by each individual user at anytime. A person skilled in the art will recognize a variety of other embodiments that can achieve these same functions related to recording, transmitting, sharing, processing, and using data, including but not limited allowing the smartphone, tablet, computer, or other device capable of receiving and transmitting information to communicate with the sensor to receive data directly from the sensor and/or transmit data to a remote storage location, such a cloud-based storage system.

Figure 15:
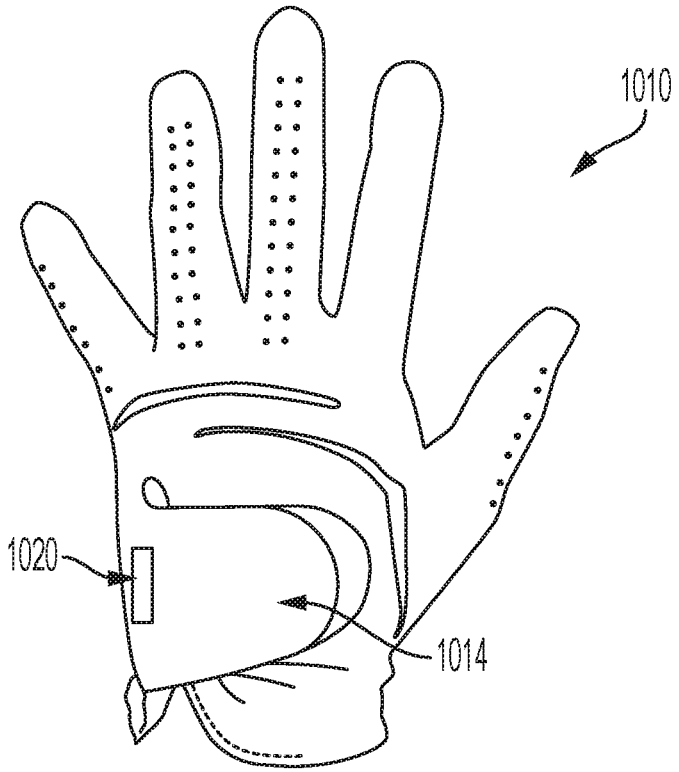
FIG. 15 is a top view of a golf glove having an accelerometer associated therewith.

Both the accelerometer and the sensor can be placed in a variety of locations on the club, including but not limited to the locations provided for above for the sensor 90, or even on a glove worn by a player. Other data gathering components can also be used to gather additional data parameters to be recorded, transmitted, shared, processed, and/or used for data analysis, evaluation, the simulation of a golf game, etc. In some instances, the components can be electronically based, like the sensor. In one exemplary embodiment, illustrated in FIG. 15, an accelerometer 1020 is used to gather additional data parameters. As shown, the accelerometer 1020 can be in the form of a strip capable of being attached to a golf glove 1010 of the user swinging the golf club. Although the accelerometer 1020 is located near a tab 1014 used to help hold the glove 1010 with respect to the hand on which it is placed, a person skilled in the art will recognize that the strip 1020 can be attached to many different locations on the glove 1010 without departing from the spirit of the present disclosure.

The accelerometer may also be attached to the shaft of the club in various locations, behind the club head, and on the butt-end of the shaft. The accelerometer can be configured to absorb and record vibrations that result from a ball strike. The impact of the golf club contacting the ball can send vibrations through the golf club and to these various locations, including the gloved hand. The vibration information can then be analyzed using algorithms to project the results discussed herein. As shown, the accelerometer 1020 is substantially rectangular in shape, although any number of other shapes can be used, including but not limited to a round accelerometer. In exemplary embodiments, the accelerometer 1020 is substantially unobtrusive so as not to negatively impact a user's golf swing. In some embodiments the accelerometer 1020 can have an adhesive formed on a back-side thereof to allow the accelerometer 1020 to be attached to the glove 1010. The adhesive can have properties allowing it to be removable and replaceable such that the accelerometer 1020 can be selectively attached and removed from the glove 1010 and selectively attached and removed from other gloves. In other embodiments the accelerometer can be attached to various locations on the club as described herein and known to those skilled in the art. A person skilled in the art would recognize exemplary adhesives that can be used in this manner. In some other embodiments the accelerometer 1020 can be pre-coupled to the glove 1010 such that a user receives the glove 1010 with the accelerometer 1020 already attached to or even embedded in it. In still other embodiments, the accelerometer 1020 can be attached to other structures, including but not limited to impact indicators provided for herein or otherwise known to those skilled in the art and the golf club, for instance on the face, head, shaft, or handle of the club, in either a removable/replaceable manner or in a more permanent manner.

The introductory data recording and transmitting product can be specifically designed to capture and record a variety of data parameters, including but not limited to swing plane, location of impact, club head speed and estimate the distance a ball travels after each swing. A person skilled in the art will recognize a number of different ways these data parameters can be used, and a number of other ways in which other data parameters related to the impact location and swing can be recorded and used by a computer program or mobile application. By way of non-limiting examples, information can be shared with a golf instructor to better an individual's game, as competition between two individuals, record a great swing or round, reference previous sessions, convert information into a virtual game etc.

Use and data gathered from this introductory product can establish the foundation upon which to enhance future hardware and software updates.

Figure 16:
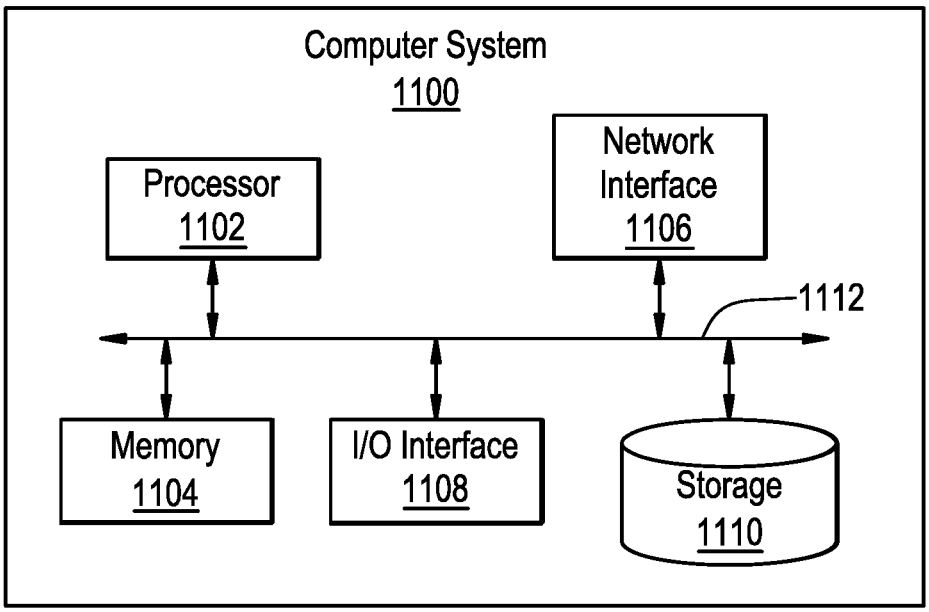
FIG. 16 is a schematic illustration of a computer system.

A person skilled in the art will recognize a variety of different computer-based technologies that can be used to carry out disclosures contained herein. For example, the devices, systems and methods disclosed herein can be implemented using one or more computer systems, such as the exemplary embodiment of a computer system 1100 shown in FIG. 16.

As shown, the computer system 1100 can include one or more processors 1102 which can control the operation of the computer system 1100. The processor(s) 1102 can include any type of microprocessor or central processing unit (CPU), including programmable general-purpose or special-purpose microprocessors and/or any one of a variety of proprietary or commercially available single or multi-processor systems. The computer system 1100 can also include one or more memories 1104, which can provide temporary storage for code to be executed by the processor(s) 1102 or for data acquired from one or more users, storage devices, and/or databases. The memory 1104 can include read-only memory (ROM), flash memory, one or more varieties of random access memory (RAM) (e.g., static RAM (SRAM), dynamic RAM (DRAM), or synchronous DRAM (SDRAM)), and/or a combination of memory technologies.

The various elements of the computer system 1100 can be coupled to a bus system 1112. The illustrated bus system 1112 is an abstraction that represents any one or more separate physical busses, communication lines/interfaces, and/or multi-drop or point-to-point connections, connected by appropriate bridges, adapters, and/or controllers. The computer system 1100 can also include one or more network interface(s) 1106, one or more input/output (TO) interface(s) 108, and one or more storage device(s) 1110.

The network interface(s) 1106 can enable the computer system 1100 to communicate with remote devices (e.g., other computer systems) over a network, and can be, for example, remote desktop connection interfaces, Ethernet adapters, and/or other local area network (LAN) adapters. The IO interface(s) 1108 can include one or more interface components to connect the computer system 1100 with other electronic equipment. For example, the IO interface(s) 1108 can include high speed data ports, such as USB ports, 1394 ports, etc. Additionally, the computer system 1100 can be accessible to a human user, and thus the IO interface(s) 1108 can include displays, speakers, keyboards, pointing devices, and/or various other video, audio, or alphanumeric interfaces. The storage device(s) 1110 can include any conventional medium for storing data in a non-volatile and/or non-transient manner. The storage device(s) 1110 can thus hold data and/or instructions in a persistent state (i.e., the value is retained despite interruption of power to the computer system 1100). The storage device(s) 1110 can include one or more hard disk drives, flash drives, USB drives, optical drives, various media cards, and/or any combination thereof and can be directly connected to the computer system 1100 or remotely connected thereto, such as over a network. The elements illustrated in FIG. 16 can be some or all of the elements of a single physical machine. In addition, not all of the illustrated elements need to be located on or in the same physical or logical machine. Rather, the illustrated elements can be distributed in nature, e.g., using a server farm or cloud-based technology. Exemplary computer systems include conventional desktop computers, workstations, minicomputers, laptop computers, tablet computers, PDAs, mobile phones, smartphones, and the like.

Although an exemplary computer system is depicted and described herein, it will be appreciated that this is for sake of generality and convenience. In other embodiments, the computer system may differ in architecture and operation from that shown and described here.

Figure 17:
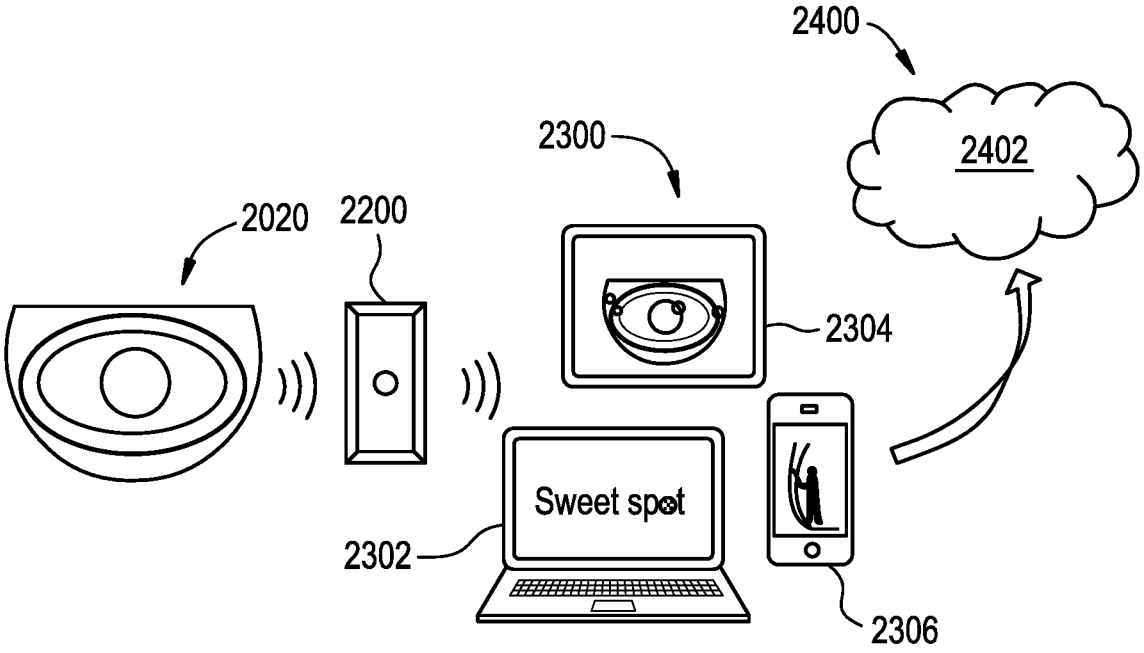
FIG. 17 is a schematic illustration of an impact indicator device being incorporated with a mobile impact recorder.

FIG. 17 provides one, non-limiting example of an embodiment that incorporates both an impact indication device and a mobile impact recorder in accordance with the disclosures provided for herein. As shown, an impact indication device 2020 is provided for on a face of a golf club, and can include a sensor (not shown) for collecting data related to a golf swing. The sensor can be disposed on any part of the device 2020, and can have a surface area that is equal to or smaller than a surface area of the device 2020. Data collected by the sensor can be transmitted to a gateway or transmitter 2200, for instance by way of wireless or Bluetooth communication. The gateway or transmitter 2200 can have a variety of configurations, but in some embodiments it can be a separate component disposed at location proximate to the golf club, such as on a golf bag, and can be configured to receive data and information from the sensor. The transmitter 2200 can also be configured to send data and information, including but not limited to the data and information received from the sensor, to a receiver 2300. Some non-limiting, illustrated examples of receivers include a computer 2302, a tablet 2304, and a smartphone 2306. Other receivers known to those skilled in the art can also be used to communicate with the transmitter 2200. In some embodiments, the transmitter 2200 can be incorporated with the receiver 2300 into a single device. As shown, the receiver 2300 can communicate data and information to a remote storage location 2400, such as a cloud-based storage location 2402. In other embodiments, the transmitter 2200 can transmit data and information directly to the remote storage location 2400. Information stored in the remote storage location 2400 can be accessed in any number of ways, including by any of the receivers 2300, the transmitter 2200, or by any other means known to those skilled in the art for accessing remotely stored data.

The disclosures provided for herein related to an impact indication device and a mobile impact recorder are practice tools designed to help golfers from beginners to the professionals track and better their swings. The various embodiments of and disclosures pertaining to an impact indication device provided for herein or otherwise derivable therefrom can be used on their own, without a mobile impact recorder. Likewise, the various embodiments of and disclosures pertaining to a mobile impact recorder provided for herein or otherwise derivable therefrom can be used on their own, without an impact indication device. Nevertheless, in some embodiments, the unique integration of a visual and mobile component can work together to provide golfers with a personalized simulator experience, regardless of their ability.

One skilled in the art will appreciate further features and advantages of the invention based on the above-described embodiments. Accordingly, the invention is not to be limited by what has been particularly shown and described, except as indicated by the appended claims. Additionally, although the present disclosure primarily discusses the impact indication device with respect to being used in conjunction with a golf club, the device and related disclosures can be easily adapted for use in a variety of other fields in which the indication of a location of impact, and the ability for the indication device to reset itself, may be desirable. Examples of such fields include but are not limited to other sports (e.g., baseball, hockey, lacrosse, tennis), aerospace, military, law enforcement, children's toys, games, hobbies, and strength testing. All publications and references cited herein are expressly incorporated herein by reference in their entirety.

What is claimed is:

1. A system for tracking golf-related data, comprising:

an electronic sensor configured to be attached to a face of a golf club;

a receiver configured to receive data from the electronic sensor, the data being related to a golf swing;

a memory component configured to record data received by the receiver;

at least one of a processor for processing data and displaying information related to the data on a display device, and a transmitter for transmitting data to a remote storage location for subsequent access of the data by a computer; and an impact indication device configured to be attached to the face of the golf club and configured to visually display a location of a strike of a golf ball by the face of the golf club, the impact indication device comprising a yield-stress material configured to be displaced in response to a most recent strike to display a location of the most recent strike and to not display locations of any previous strikes, wherein the yield-stress material is further configured to (i) exist as a semi-rigid solid when not under threshold stress, and (ii) flow when under threshold stress.

2. The system of claim 1, wherein the receiver and the memory component are separately located, with the receiver being configured to transmit data to the memory component wirelessly.

3. The system of claim 1, wherein the electronic sensor is a component of the impact indication device.

4. The system of claim 1, further comprising an accelerometer configured to be attached to a glove being worn by a user swinging the golf club, and configured to send data measured by the accelerometer to the receiver.

5. A method for indicating golf swing data using a mobile device having a computer processor coupled to a receiver, a display, and memory, and a golf club having a face, the method comprising:

receiving by the receiver one or more golf swing data parameters;

storing the golf swing data in the memory;

processing the one or more data parameters by the computer processor to calculate one or more displayable indications;

displaying the one or more displayable indications on the display; and causing an impact indication device that is attached to the face of the golf club to visually display a location of a strike of a golf ball by the face of the golf club, the impact indication device comprising a yield-stress material configured to be displaced in response to a most recent strike to display a location of the most recent strike and to not display locations of any previous strikes, wherein the yield-stress material is further configured to (i) exist as a semi-rigid solid when not under threshold stress, and (ii) flow when under threshold stress.

6. The method of claim 5, wherein the one or more golf swing data parameters is received from a sensor attached to a golf club used to execute a golf swing.

7. The method of claim 6, wherein the sensor is attached to a head of the golf club.

8. The method of claim 5, wherein the impact indication device is configured to reset itself such that a location of a most recent ball strike is displayed via the indication device and locations of previous ball strikes are not displayed via the indication device.

9. The method of claim 5, wherein the one or more data parameters can include at least one of a swing plane of the golf club during the golf swing, a location of a ball strike on the head of the golf club, and a speed of the head of the golf club during the golf swing.

10. The method of claim 5, wherein processing the one or more data parameters further comprises simulating a game of golf.

11. The method of claim 5, wherein processing the one or more data parameters further comprises providing instructional analysis about the golf swing.

12. The method of claim 5, wherein processing the one or more data parameters further comprises estimating a distance a golf ball would travel in response to the golf swing based on the one or more data parameters.

13. The method of claim 5, further comprising:

wirelessly transmitting the one or more data parameters to a remote data storage location for access to the one or more data parameters by a computer.

14. The method of claim 13, wherein data received by the receiver is first transmitted to a transmitter in communication with the sensor, the transmitter being configured to send one or more data parameters to the receiver.

15. The method of claim 5, further comprising:

receiving by the receiver one or more additional data parameters by the computer processor to calculate one or more additional displayable indications; and displaying the one or more additional displayable indications on the display.

* * * * *